US011153680B2

(12) United States Patent
Small et al.

(10) Patent No.: US 11,153,680 B2
(45) Date of Patent: Oct. 19, 2021

(54) STACKABLE LOUDSPEAKERS

(71) Applicant: Bose Corporation, Framingham, MA (US)

(72) Inventors: Craig Small, Framingam, MA (US); Peter C. Santoro, Groton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/790,356

(22) Filed: Feb. 13, 2020

(65) Prior Publication Data

US 2021/0258685 A1 Aug. 19, 2021

(51) Int. Cl.

| | |
|---|---|
| ***H04R 1/40*** | (2006.01) |
| ***H04R 1/02*** | (2006.01) |
| ***H04R 3/12*** | (2006.01) |
| ***H04R 29/00*** | (2006.01) |

(52) U.S. Cl.

CPC ..... *H04R 1/403* (2013.01); *H04R 1/025* (2013.01); *H04R 1/026* (2013.01); *H04R 3/12* (2013.01); *H04R 29/002* (2013.01); *H04R 2201/025* (2013.01)

(58) Field of Classification Search

CPC ..... H04R 1/403; H04R 1/025; H04R 1/026; H04R 3/12; H04R 29/002; H04R 2201/025; H04R 1/2815–2826

See application file for complete search history.

(56) References Cited

U.S. PATENT DOCUMENTS

| | | | |
|---|---|---|---|
| 3,722,616 | A | 3/1973 | Beavers |
| 3,739,096 | A | 6/1973 | Iding |
| 4,054,748 | A | 10/1977 | Balogh |

(Continued)

FOREIGN PATENT DOCUMENTS

| | | | |
|---|---|---|---|
| DE | 102008013627 | A1 | 9/2009 |
| DE | 102008013627 | B8 | 6/2015 |

(Continued)

OTHER PUBLICATIONS

International Search Report and Written Opinion, dated Apr. 29, 2012 for PCT/US2021/017598.

(Continued)

*Primary Examiner* — Mark Fischer
(74) *Attorney, Agent, or Firm* — Bose Corporation

(57) ABSTRACT

A loudspeaker includes a housing that has a plurality of walls, which together define an acoustic cavity. An electro-acoustic transducer is mounted to a front wall of the housing, and a motion axis of the electro-acoustic transducer is offset from a centroid of the front wall. The loudspeaker is configured to be stacked with an other loudspeaker of identical construction in a first configuration such that the stacked loudspeakers radiate acoustic energy to produce an omnidirectional radiation pattern; and in a second configuration such that the stacked loudspeakers radiate acoustic energy to produce a cardioid radiation pattern. The loudspeaker includes keyed features which do not interlock and thereby inhibit stacking when the loudspeaker is in a first orientation relative to the other loudspeaker, and which interlock to allow stacking when the loudspeaker is in a second orientation relative to the other loudspeaker.

15 Claims, 22 Drawing Sheets

(56) References Cited

U.S. PATENT DOCUMENTS

| | | | | |
|---|---|---|---|---|
| 6,665,412 | B1 | 12/2003 | Mizoguchi | |
| 7,480,389 | B2 | 1/2009 | Ricks et al. | |
| 8,391,510 | B2 | 3/2013 | Vincenot | |
| 8,428,284 | B2 | 4/2013 | Meyer et al. | |
| D685,392 | S | 7/2013 | Chamness et al. | |
| 8,842,866 | B2 | 9/2014 | Christner | |
| 9,288,571 | B2 | 3/2016 | Christner et al. | |
| 9,635,454 | B2 | 4/2017 | Larrieu | |
| 9,716,940 | B2 | 7/2017 | Roberts | |
| 10,104,469 | B2 | 10/2018 | Jakowski | |
| 10,123,111 | B2 | 11/2018 | Gunness | |
| 2006/0222190 | A1 | 10/2006 | Jacobs et al. | |
| 2007/0263888 | A1* | 11/2007 | Melanson | H04S 3/00 381/300 |
| 2008/0080727 | A1 | 4/2008 | Prenta et al. | |
| 2008/0085022 | A1 | 4/2008 | Polster | |
| 2010/0111342 | A1 | 5/2010 | Jacob et al. | |
| 2013/0322656 | A1 | 12/2013 | Adams | |
| 2015/0104037 | A1 | 4/2015 | Lee et al. | |
| 2015/0289037 | A1* | 10/2015 | Kutil | H04R 1/403 381/387 |
| 2015/0358734 | A1* | 12/2015 | Butler | H04R 1/30 381/59 |
| 2016/0353198 | A1* | 12/2016 | Sahyoun | H04R 1/2834 |
| 2017/0289675 | A1 | 10/2017 | Isotalo et al. | |
| 2020/0396535 | A1 | 12/2020 | Zastoupil | |

FOREIGN PATENT DOCUMENTS

| | | | |
|---|---|---|---|
| EP | 3018915 | B1 | 6/2018 |
| JP | 09322295 | A * | 12/1997 |

OTHER PUBLICATIONS

Anonymous: "M3D-SUB: Directional Subwoofer", Jan. 1, 2003, pp. 1-2 , XP055796939, Retreived from the Internet: URL:http://www.artecchino-techno.ru/img_out/equipment_files/uploadlgcjjcpbyw1.pdf. the whole document.

* cited by examiner

STACKABLE LOUDSPEAKERS

BACKGROUND

This disclosure relates to stackable loudspeakers and related systems and methods.

SUMMARY

All examples and features mentioned below can be combined in any technically possible way.

In an aspect, a loudspeaker includes a housing that has a plurality of walls, which together define an acoustic cavity. An electro-acoustic transducer is mounted to a front wall of the housing, and a motion axis of the electro-acoustic transducer is offset from a centroid of the front wall. The loudspeaker is configured to be stacked with an other loudspeaker of identical construction in a first configuration such that the stacked loudspeakers radiate acoustic energy to produce an omnidirectional radiation pattern; and in a second configuration such that the stacked loudspeakers radiate acoustic energy to produce a cardioid radiation pattern. The loudspeaker includes keyed features which do not interlock and thereby inhibit stacking when the loudspeaker is in a first orientation relative to the other loudspeaker, and which interlock to allow stacking when the loudspeaker is in a second orientation relative to the other loudspeaker.

Implementations may include one of the following features, or any combination thereof.

In some implementations, the loudspeaker includes electronics for processing an electrical audio signal and powering the transducer. The electronics are configured to introduce phase shift and time delay to the electrical audio signal when the loudspeaker is stacked with the other loudspeaker in the second configuration.

In certain implementations, the keyed features of the loudspeaker and the other loudspeaker are arranged to as to interlock when the respective motion axes of the electro-acoustic transducers of the loudspeakers are aligned in a vertical plane in each of the first and second configurations.

In some cases, the plurality of walls includes the front wall, a top wall, a bottom wall, and a plurality of sidewalls that extend between the top wall and the bottom wall. The keyed features of the loudspeaker and the other loudspeaker are arranged so as to interlock when the respective top walls of the housings of the loudspeakers are aligned in a vertical plane in each of the first and second configurations.

In certain cases, the keyed features of the loudspeaker and the other loudspeaker are arranged such that they do not interlock when the top wall of the loudspeaker is arranged in a vertical plane with the bottom wall of the other loudspeaker.

In some examples, the loudspeaker includes a port that extends through the front wall. The keyed features of the loudspeaker and the other loudspeaker are arranged to as to interlock when the respective ports of the loudspeakers are aligned in a vertical plane in each of the first and second configurations.

In certain examples, the electro-acoustic transducer includes a diaphragm having a major axis and a minor axis that is shorter than the major axis.

In some implementations, the diaphragm is in the shape of an ellipse, an oval, or a racetrack (having parallel sides that extend along the major axis and rounded ends that extend between the parallel sides, a/k/a "stadium").

In certain implementations, the plurality of walls includes the front wall, a top wall, a bottom wall, and a plurality of sidewalls that extend between the top wall and the bottom wall. The sidewalls are substantially parallel with the major axis of the electro-acoustic transducer. The top wall has a handle such that the loudspeaker can be carried with the major axis arranged vertical to ground.

In some cases, the loudspeaker includes a sensor that is configured to detect when the loudspeaker is arranged in the second configuration with the other loudspeaker, and, in response, automatically applies a phase shift and a time delay to an electrical audio signal that is used to drive the electro-acoustic transducer.

In certain cases, the keyed features include protrusions and recesses which interlock when properly aligned.

In another aspect, an audio system includes first and second loudspeakers.

Each of the first and second loudspeakers includes a housing having a plurality of walls which together define an acoustic cavity, an electro-acoustic transducer mounted to a front wall of the housing, and keyed features. A motion axis of the electro-acoustic transducer is offset from a centroid of the front wall. The first and second loudspeakers are configured to be stacked on top of one another (i) in a first configuration such that the first and second loudspeakers radiate acoustic energy to produce an omnidirectional radiation pattern, and (ii.) in a second configuration such that the first and second loudspeakers radiate acoustic energy to produce a cardioid radiation pattern. The respective keyed features of the first and second loudspeakers do not interlock and thereby inhibit stacking when the first and second loudspeakers are in a first orientation relative to each other, and interlock to allow stacking when the first and second loudspeakers are in a second orientation relative to each other.

Implementations may include one of the above and/or below features, or any combination thereof.

In some implementations, the first and second loudspeakers are configured to automatically detect when they are stacked in the second configuration.

In certain implementations, the first and second loudspeakers are configured to be coupled with a line array loudspeaker (e.g., wirelessly, e.g., via Bluetooth, or via a cable connection) and the loudspeaker includes: an array housing; and a plurality of electro-acoustic transducers arranged along a vertical axis and configured to radiate acoustic energy outwardly from a front surface of the array housing.

In some cases, the first and second loudspeakers are configured to automatically detect which one of the first and second loudspeakers has its front wall facing in the direction that the line array is radiating acoustic energy, and, automatically apply a phase shift and a time delay to an audio signal that is used to drive the electro-acoustic transducer of the other one of the first and second loudspeakers.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure.

DETAILED DESCRIPTION

The present disclosure relates to a configuration for stackable loudspeaker. The configuration allows a pair of such loudspeakers to be stacked, one on top of the other, to provide, at the user's discretion, either an omnidirectional radiation pattern or a cardioid radiation pattern. The omnidirectional radiation pattern is achieved when the two loudspeakers are stacked such that they both face the same direction. The cardioid pattern is achieved when the two loudspeakers are stacked such that they face in opposite directions.

In order to achieve the desired radiation pattern, particularly when the loudspeakers are stacked to provide a cardioid output, the loudspeakers are provided with keyed features, e.g., protrusions and recesses, on their respective mating surfaces that inhibit (e.g., prevent) stacking in an incorrect orientation in the cardioid configuration. That is, the keyed features inhibit stacking when respective motion axes of the electro-acoustic transducers of the loudspeakers are not aligned in a manner that produces the desired radiation pattern. This can be particularly beneficial when the motion axis of the electro-acoustic transducer is offset from a centroid of the loudspeaker.

Loudspeaker

Figure 3:
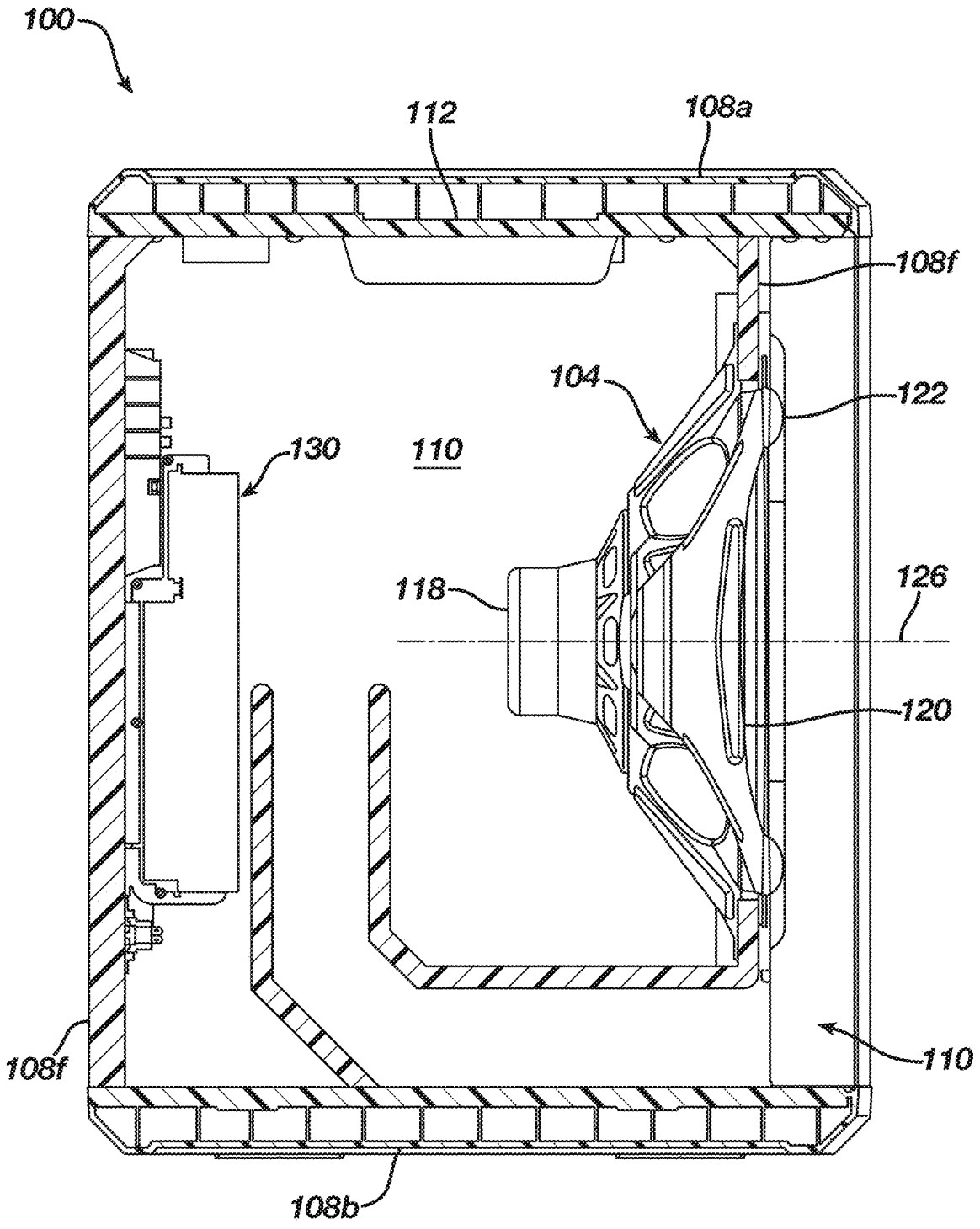
FIG. 3 is a cross-sectional side view of the loudspeaker of FIG. 1A.

FIGS. 1A-3 illustrate an exemplary loudspeaker 100. The loudspeaker 100 includes a housing 102 that supports an electro-acoustic transducer 104 and a bass reflex port 106. The housing 102 includes a plurality of walls (collectively "108"), which define an acoustic cavity 110 (FIG. 3). The plurality of walls 108 include a top wall 108*a*; a bottom wall 108*b*, left and right sidewalls 108*c*, 108*d*, respectively; a front wall 108*e*; and a rear wall 108*f*. The electro-acoustic transducer 104 and the bass reflex port 106 are supported by the front wall 108*e*. The top wall 108*a* supports a handle 112 for carrying the loudspeaker 100. The rear wall 108*f* supports an input/output (i/o) panel 114 (FIG. 1B). The left and right sidewalls 108*c*, 108*d* have keyed features 116, which, as discussed in greater detail below, allow the loudspeaker 100 to be stacked with an other loudspeaker of identical construction. In some implementations, the loudspeaker 100 may include a pole mounts 117 that is configured to receive an end of a mounting pole, as shown on the left sidewall 108*c* in FIG. 1B. In some cases, the loudspeaker 100 is a subwoofer having an operating frequency range of about 20 Hz to about 200 Hz, e.g., about 35 Hz to about 200 Hz, e.g., about 40 Hz to about 200 Hz.

The electro-acoustic transducer 104 can be any known type of electro-acoustic transducer. For example, as shown in FIG. 3, the electro-acoustic transducer 104 can include an electric motor 118, a diaphragm 120, and a suspension 122. Notably, the diaphragm 120 has an oblong shape, e.g., the shape of an ellipse, an oval, or a racetrack (having parallel sides that extend along the major axis and rounded ends that extend between the parallel sides, a/k/a "stadium"). The diaphragm 120 is arranged such that its major axis 124 (FIG. 2) is arranged vertically when the loudspeaker 100 is transported (carried by its handle 112) so that the center of mass of the loudspeaker 100 rests closer to the user's body (as compared to a design with a circular diaphragm with an equivalent surface area). The benefit(s) is/are this configuration allows for narrower loudspeaker 100 that is easier to carry. The oblong diaphragm 120 provides same output but with tighter density as compared to a round diaphragm with an equivalent radiating surface area. The oblong diaphragm 120 also provides for more efficient use of space as compared to an arrangement with multiple small transducers that collectively have the equivalent radiating surface area.

The bass reflex port 106 extends through the front wall 108*e* and acoustically couples the acoustic cavity 110 the environment surrounding the loudspeaker 100. The bass reflex port 106 is arranged alongside the electro-acoustic transducer 104 such that the motion axis of the electro-acoustic transducer 104 is offset from the centroid 128 of the front wall 108*e*, such that the centroid 128 is disposed between the motion axis 126 of the electro-acoustic transducer 104 and the bass reflex port 106.

Stacking

Figure 4A:
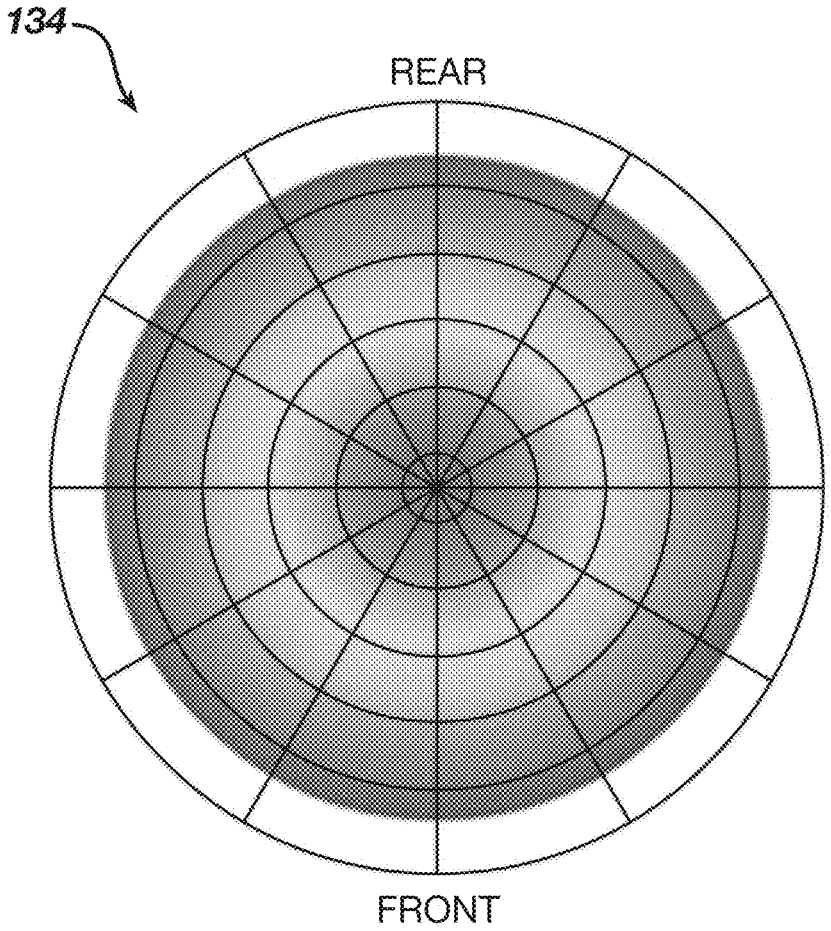
FIG. 4A is a polar plot of an omnidirectional radiation pattern.
Figure 4B:
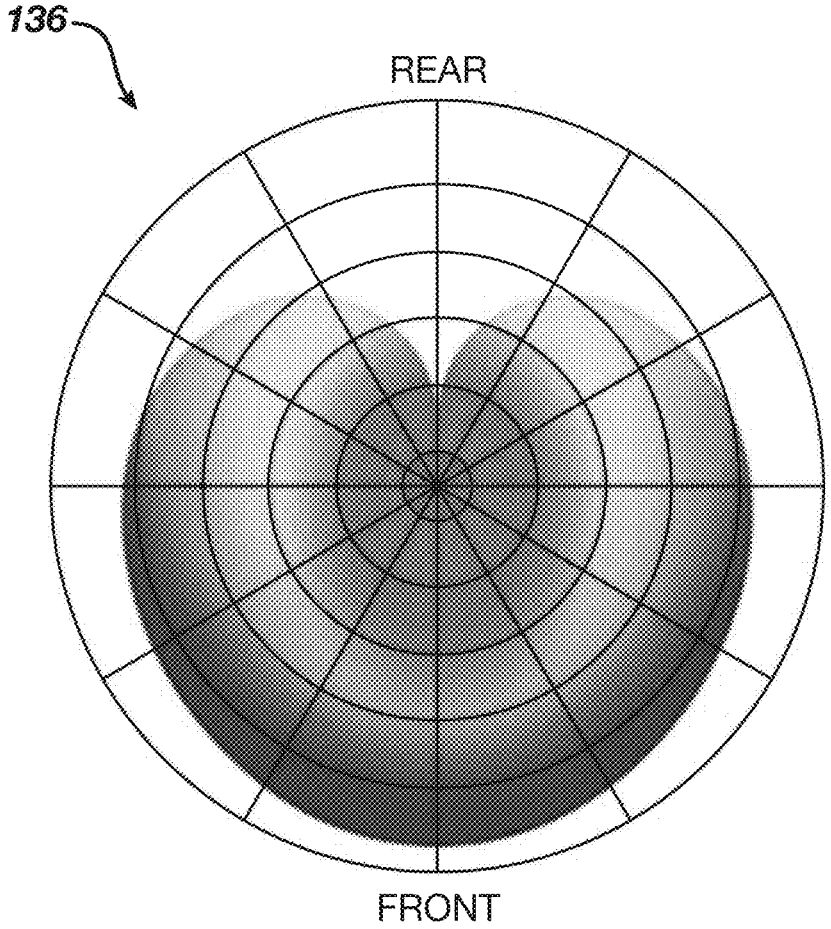
FIG. 4B is a polar plot of a desired cardioid radiation pattern.

Referring to FIG. 3, the loudspeaker 100 includes electronics 130 for processing audio signal received via a connector 132 (FIG. 1B) and driving the electro-acoustic transducer 104. The loudspeaker 100 is configured such that it can be stacked on top of an other loudspeaker 100 having the same construction to produce either an omnidirectional output 400 (FIG. 4A) or a cardioid output 136 (FIG. 4B).

In the omnidirectional configuration, the loudspeakers 100 are stacked such that the front walls 108*e* of the loudspeakers 100 lie in a common vertical plane (face in the same direction) and such that the major axes 124 of the transducer diaphragms 120 are arranged substantially parallel to ground (i.e., such that the minor axes 138 (FIG. 2) of the transducer diaphragms 120 are normal to ground).

In the cardioid configuration, the electronics 130 are configured to introduce phase shift and time delay to an audio signal provided to the associated electro-acoustic transducer 104 on one of the loudspeakers 100 selected to operate in cardioid mode. The loudspeaker 100 selected to operate in cardioid mode is the loudspeaker 100 in the stack, that faces the rear of the stack, away from the direction in which audio is to be provided (i.e., faces away from an audience).

When stacked (such that each of the loudspeakers lays on one of its sidewalls), it may be desirable that the respective motion axes 126 of the loudspeakers 100 are arranged in the same vertical plane (i.e., such that the minor axes of the transducer diaphragms are coincident). The failure to do so may result in an undesirable, or less than optimal sound field. For example, if the motion axes and/or bass reflex ports are offset and when the loudspeakers 100 are stacked in the cardioid configuration, the radiation pattern may not match the desired cardioid pattern shown in FIG. 4B, and, consequently, may result in a radiation pattern does not satisfy the user's needs.

Figure 5:
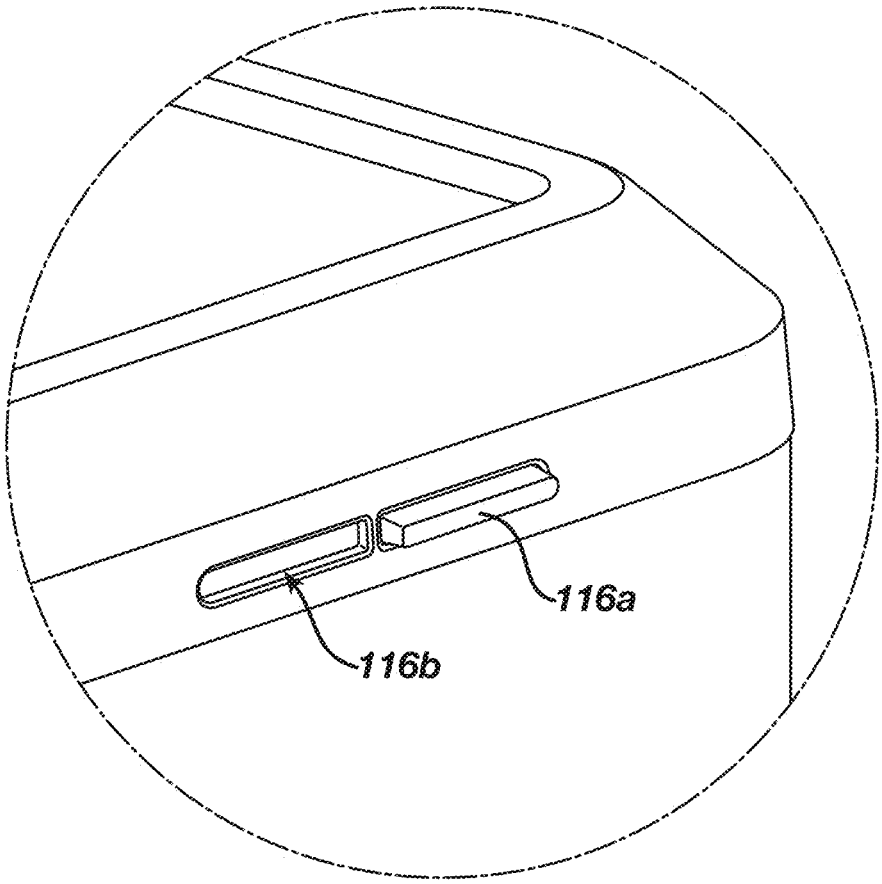
FIG. 5 is a detail of keyed features from detail 5-5 of FIG. 1A.

To ensure that the motion axes are properly aligned when stacked, the loudspeaker 100 is provided with the keying features 116 that prevent the loudspeakers 100 from being stacked such that their respective motion axes 126 are offset from each other horizontally. In the example illustrated in FIG. 5, the keyed features 116 comprise protrusions 116*a* which extend outwardly from the outer surface of the sidewalls; and recesses 116*b*, which are configured to receive the protrusions of a second loudspeaker when properly stacked. I.e., such that the handles of the two loudspeakers are arranged along the same side of the stack, in the same vertical plan when the loudspeakers are stacked on their sides. In the illustrated implementation, the protrusions 116*a* are in the form of feet that extend outwardly from the surfaces of the left and right sidewalls 108*c*, 108*d*, and the recesses 116*b* are in the form of pockets in the left and right sidewalls 108*c*, 108*d*. Each foot is paired with a pocket with four foot/pocket pairs on each sidewall 108*c*, 108*d*.

Figure 6A:
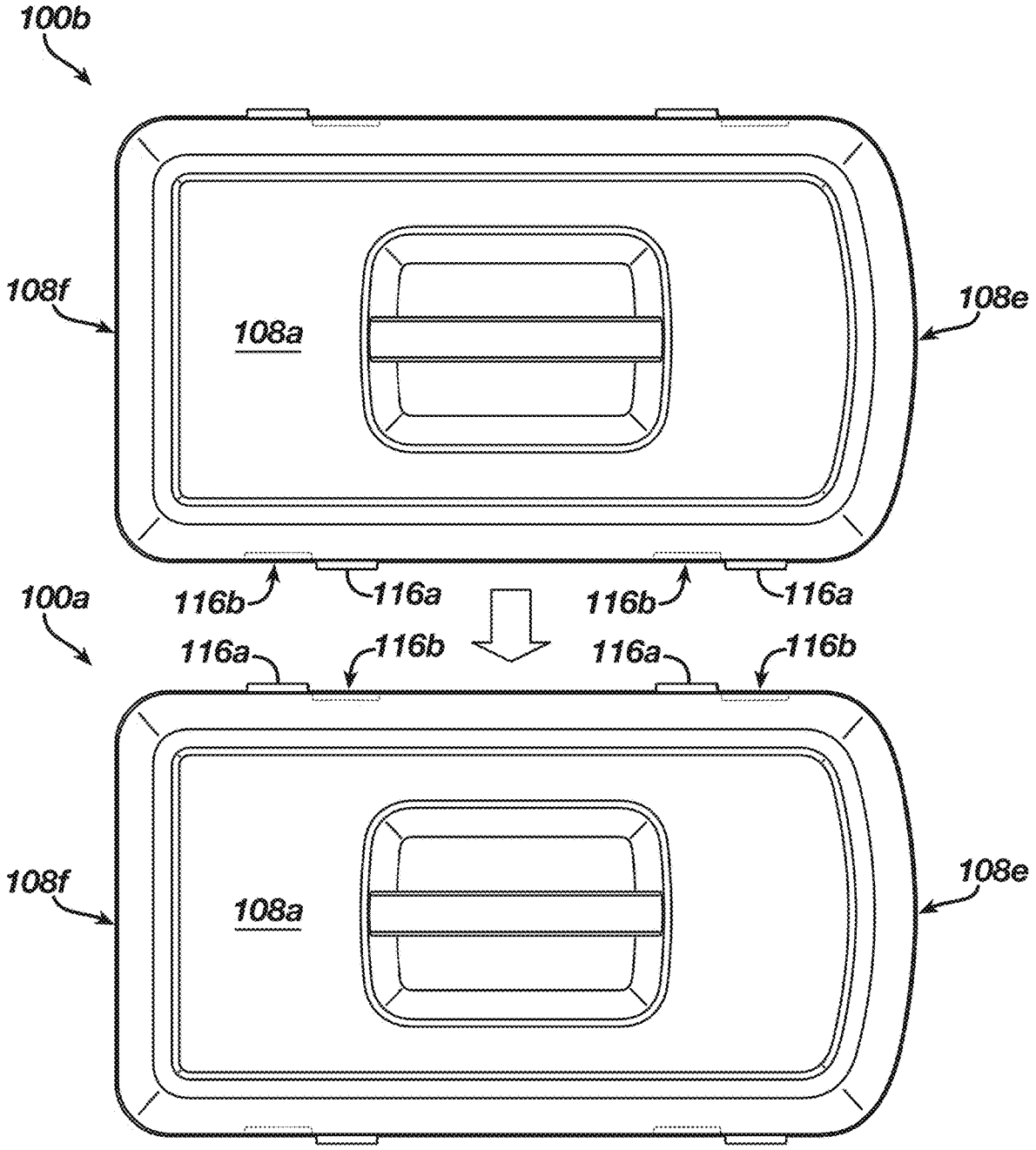
FIG. 6A is a side view of loudspeakers being stacked properly in omnidirectional configuration.
Figure 6B:
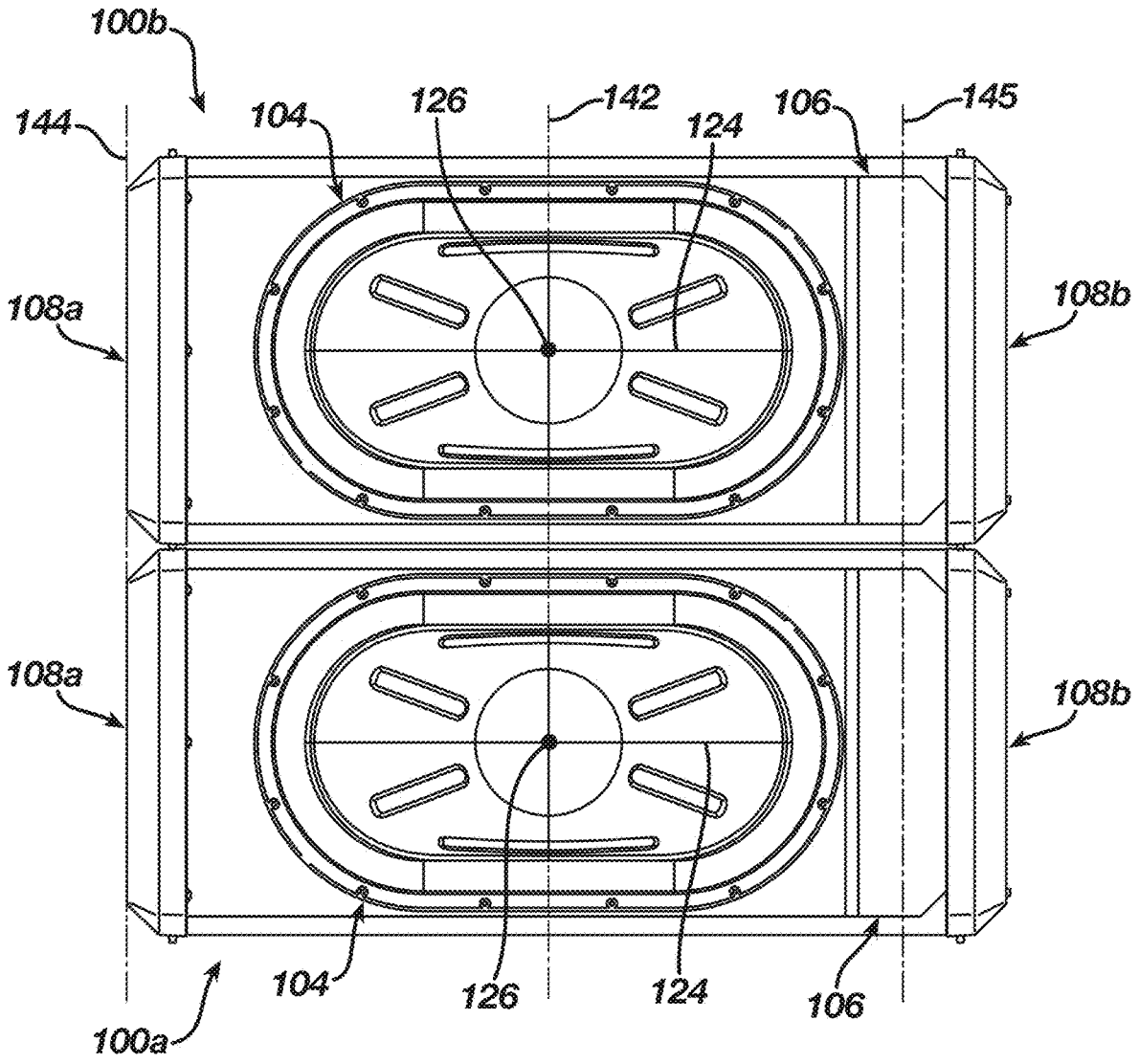
FIG. 6B is a front view of loudspeakers stacked properly in the omnidirectional configuration.

FIG. 6A shows a pair of loudspeakers 100*a*, 100*b* being stacked properly in the omnidirectional configuration. As shown in the figure, the protrusions 116*a* on a first one of the loudspeakers 100*a* align with the recesses 116*b* of on a second one of the loudspeakers 100*b*, and vice versa, so that, when stacked, the protrusions 116*a* rest in the recesses 116*b*. As shown in FIG. 6B, when the loudspeakers 100*a*, 100*b* are properly stacked in the omnidirectional configuration, the respective motion axes 126 of the transducers 104 are aligned in a vertical plane 142. In the proper omnidirectional configuration, the respective top walls 108*a* of the loudspeakers 100*a*, 100*b* are also aligned in a vertical plane 144, likewise for the bottom walls 108*b*. Or, stated another way, in the proper omnidirectional configuration the respective motion axes 126 of the transducers 104 are aligned in a plane 142 that is substantially perpendicular to the major axes 124 of the electro-acoustic transducers 104. Also, in the proper omnidirectional configuration, the respective ports 106 are aligned in a plane 145 that is substantially perpendicular to the major axes 124 of the electro-acoustic transducers 104.

Figure 6C:
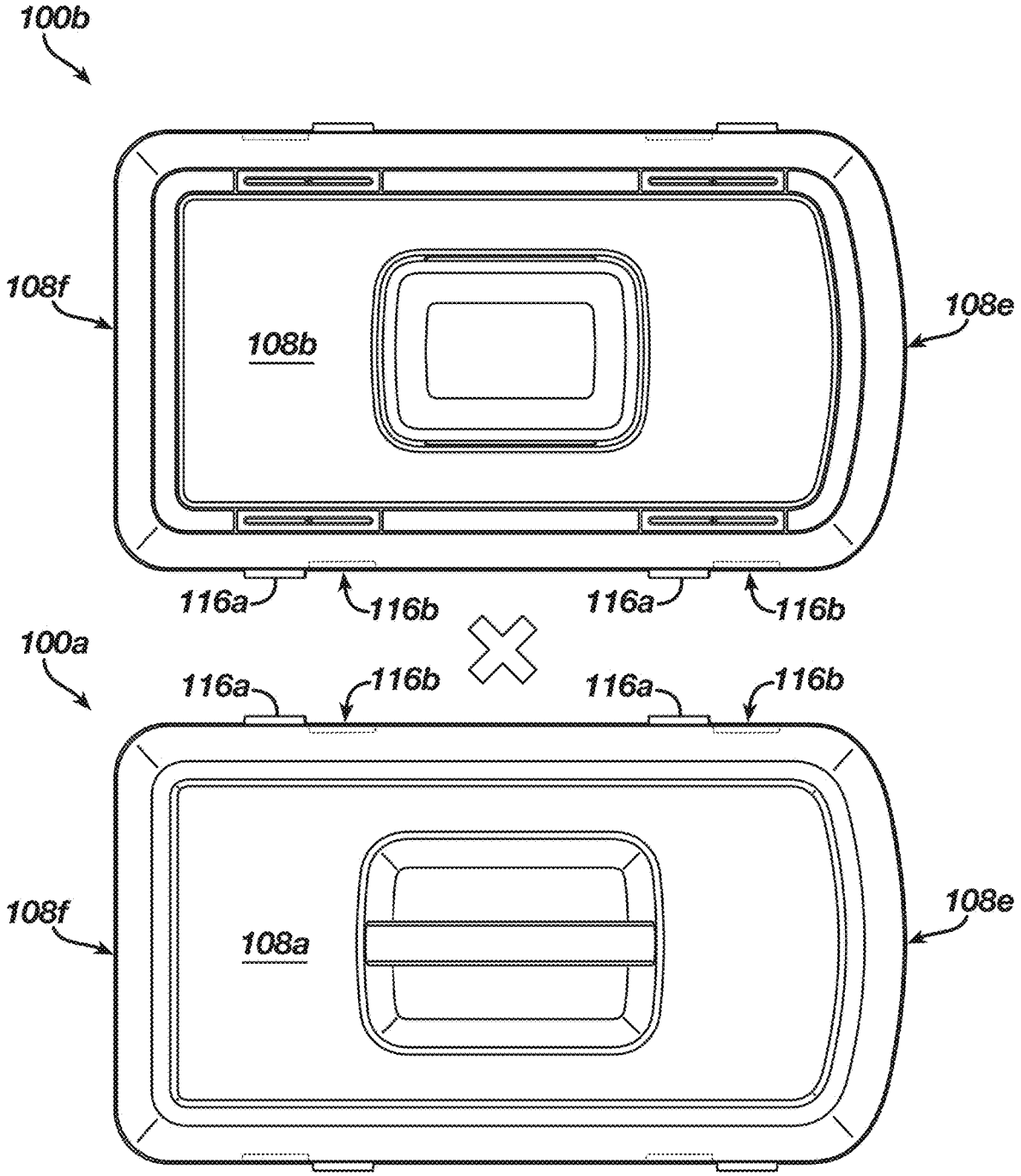
FIG. 6C is a side view of loudspeakers being stacked improperly in omnidirectional configuration.
Figure 6D:
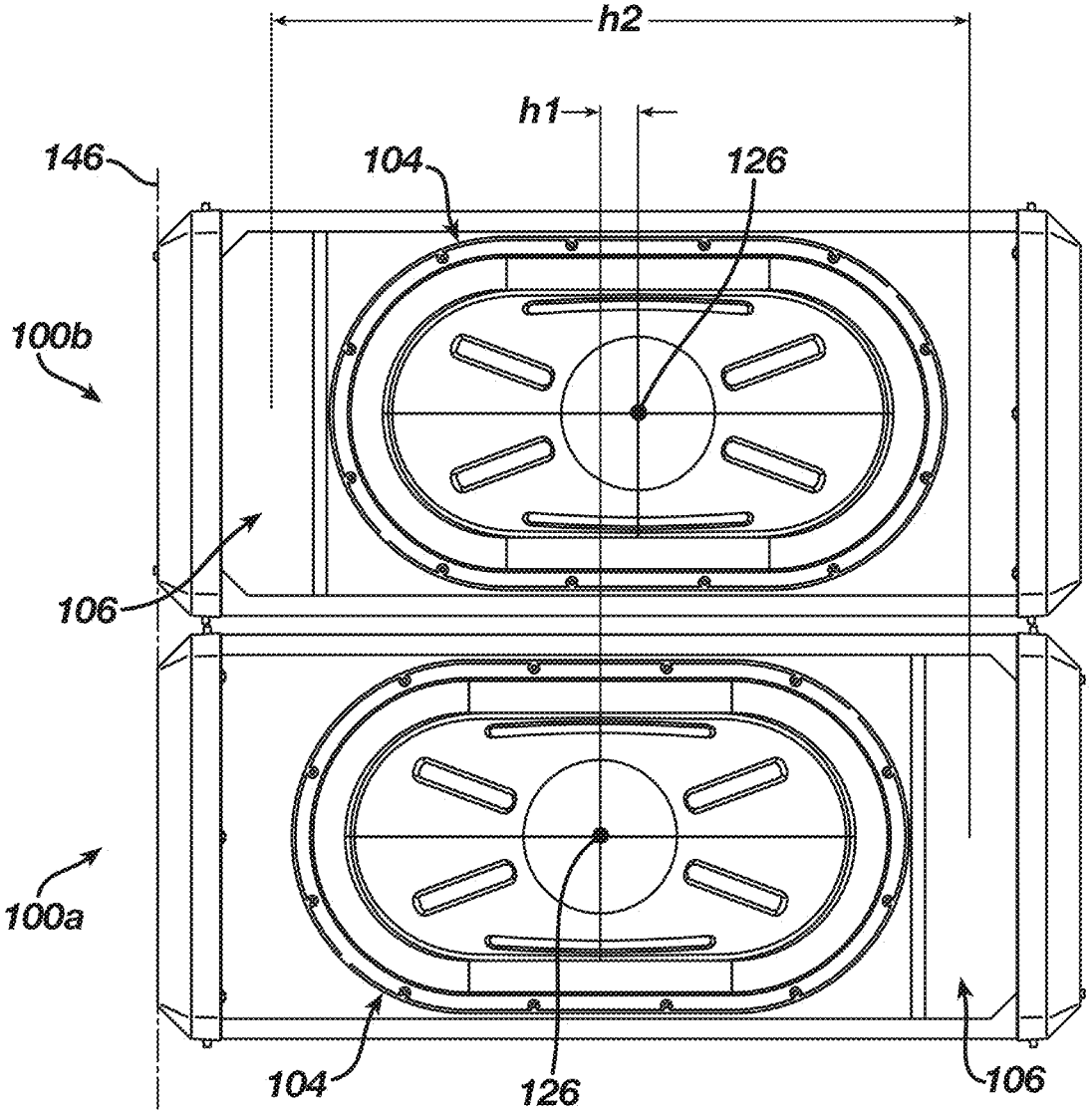
FIG. 6D is a front view of loudspeakers stacked improperly in omnidirectional configuration.

As shown in FIG. 6C, the keyed features 116 also inhibit improper stacking in the omnidirectional configuration. In that regard, the keyed features 116 are arranged such that they do not interlock when the top wall 108*a* of the first loudspeaker 100*a* is arranged in a vertical plane 146 (FIG. 6D) with the bottom wall 108*b* of the second loudspeaker 100*b*. In that regard, when the loudspeakers 100*a*, 100*b* are not properly stacked, the protrusions 116*a* in the respective loudspeakers 100*a*, 100*b* interfere with each other. With reference to FIG. 6D, this inhibits a stacking of the loudspeakers 100*a*, 100*b* that would result in the respective motion axes 126 of the electro-acoustic transducers 104 being horizontally offset from each other by a distance, h1, as well as the respective ports 16 being horizontally offset from each other by a distance, h2.

Figure 7A:
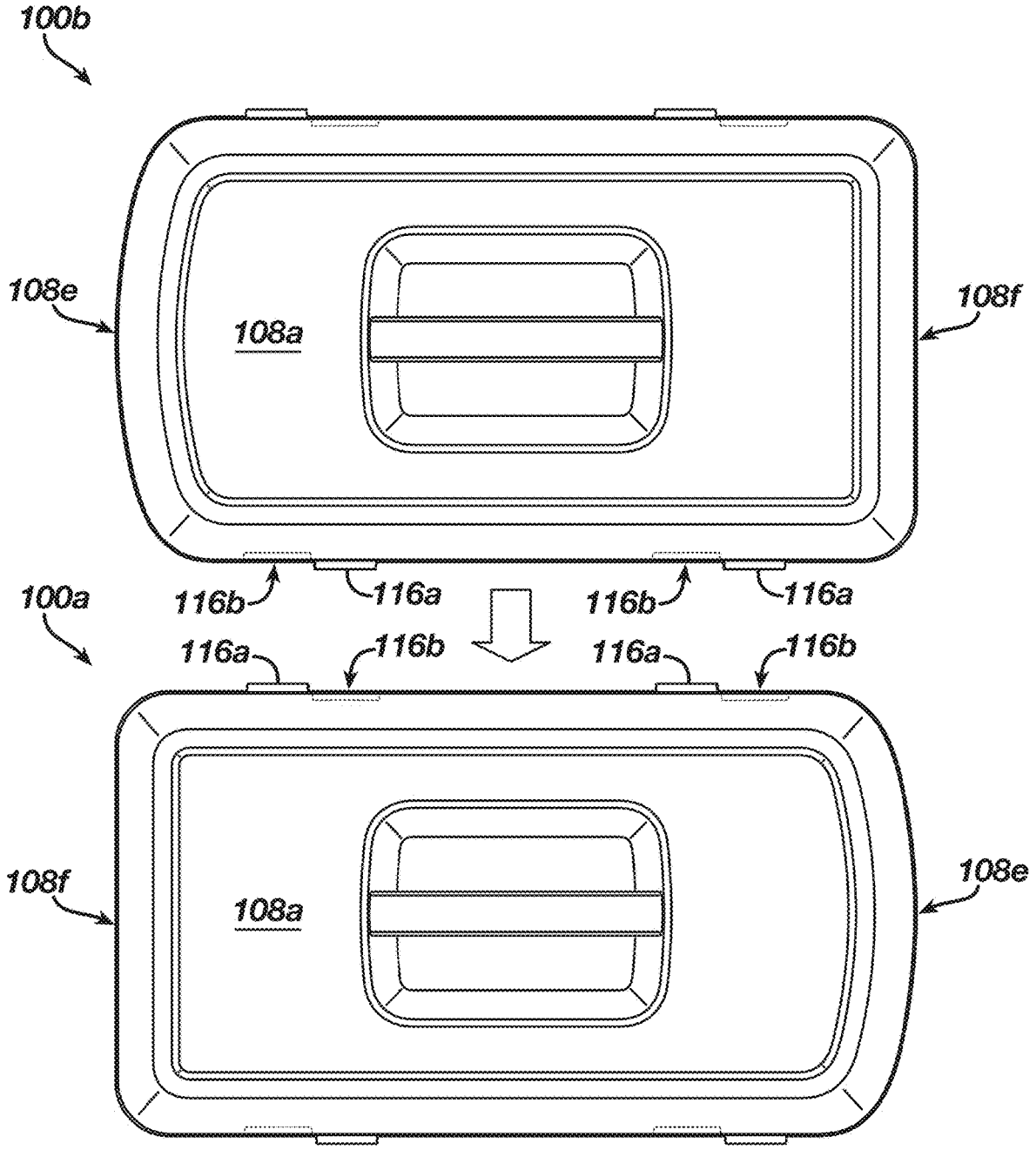
FIG. 7A is a side view of loudspeakers being stacked properly in cardioid configuration.
Figure 7B:
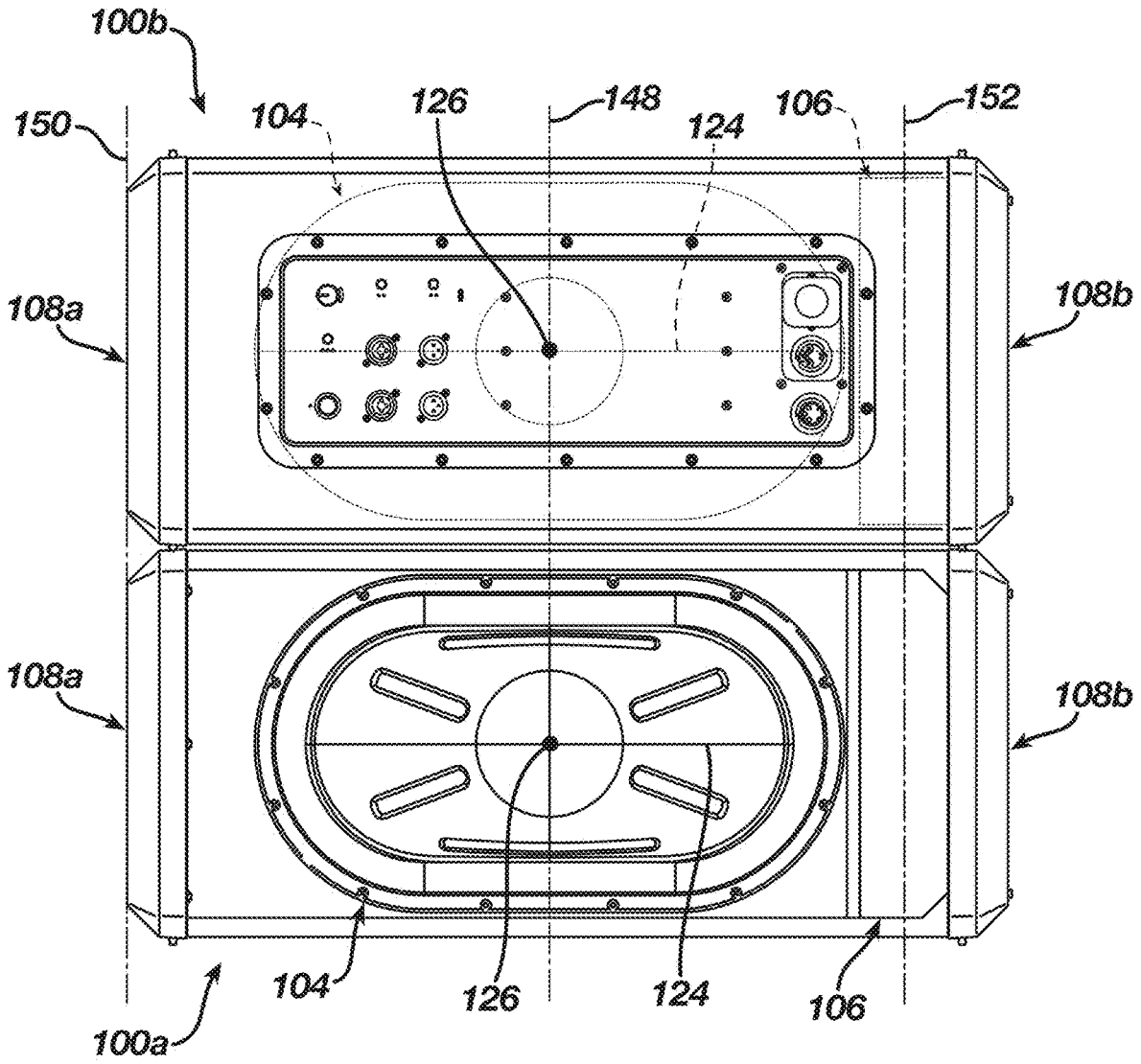
FIG. 7B is a front view of loudspeakers stacked properly in the cardioid configuration.

FIG. 7A shows a pair of loudspeakers 100*a*, 100*b* being stacked properly in the cardioid configuration. As shown in the figure, the protrusions 116*a* on a first one of the loudspeakers 100*a* align with the recesses 116*b* on a second one of the loudspeakers 100*b*, and vice versa, so that, when stacked, the protrusions 116*a* are received within the recesses 116*b*. As shown in FIG. 7B, when the loudspeakers 100*a*, 100*b* are properly stacked in the cardioid configuration, the respective motion axes 126 of the transducers 104 are aligned in a vertical plane 148. In the proper cardioid configuration, the respective top walls 108*a* of the loudspeakers 100*a*, 100*b* are also aligned in a vertical plane 150, likewise for the bottom walls 108*b*. Or, stated another way, in the proper cardioid configuration the respective motion axes 126 are aligned in a plane 148 that is substantially perpendicular to the major axes 124 of the electro-acoustic transducers 104. Also, in the proper cardioid configuration, the respective ports 106 are aligned in a plane 152 that is substantially perpendicular to the major axes 124 of the electro-acoustic transducers 104.

Figure 7C:
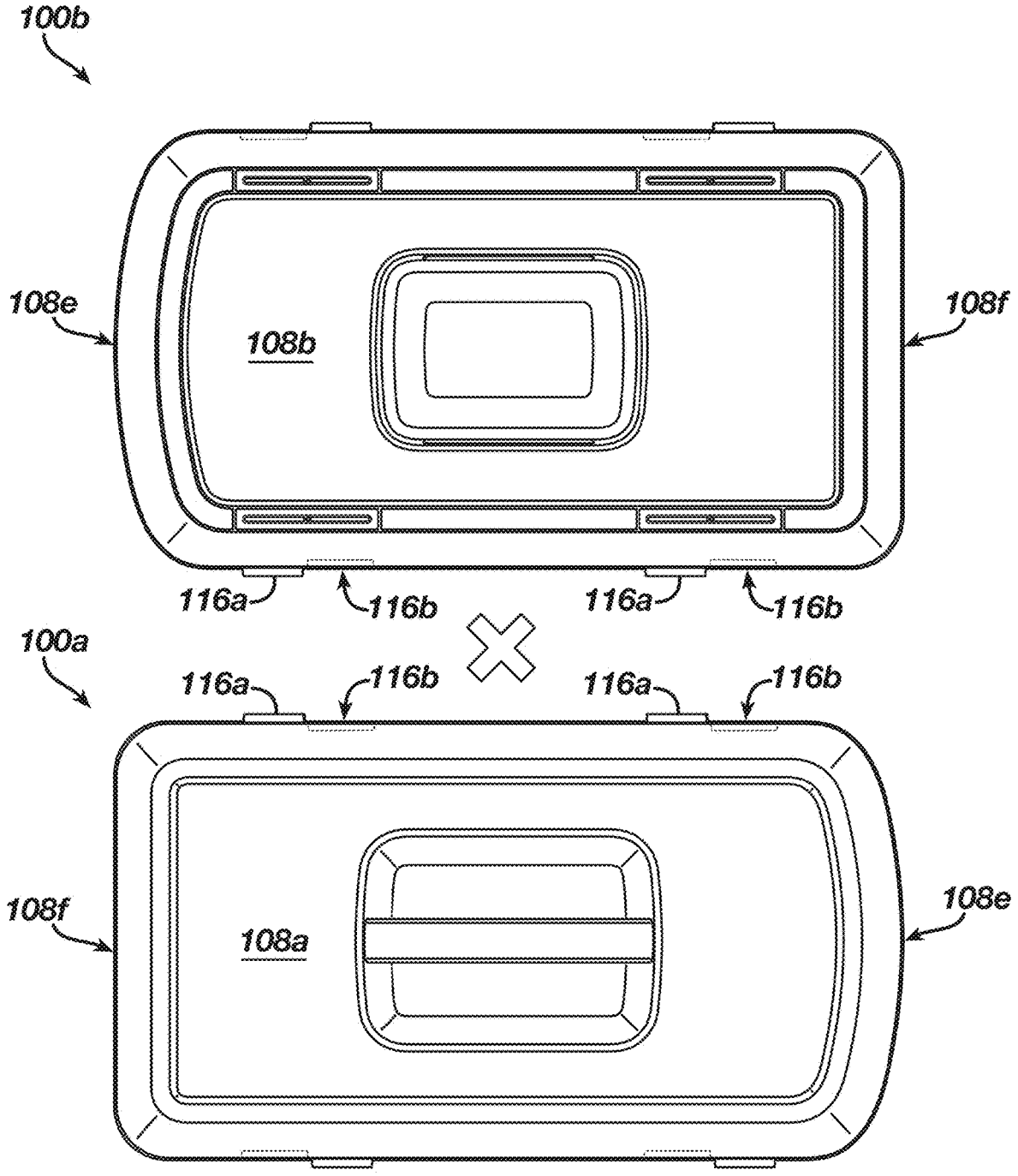
FIG. 7C is a side view of loudspeakers being stacked improperly in cardioid configuration.
Figure 7D:
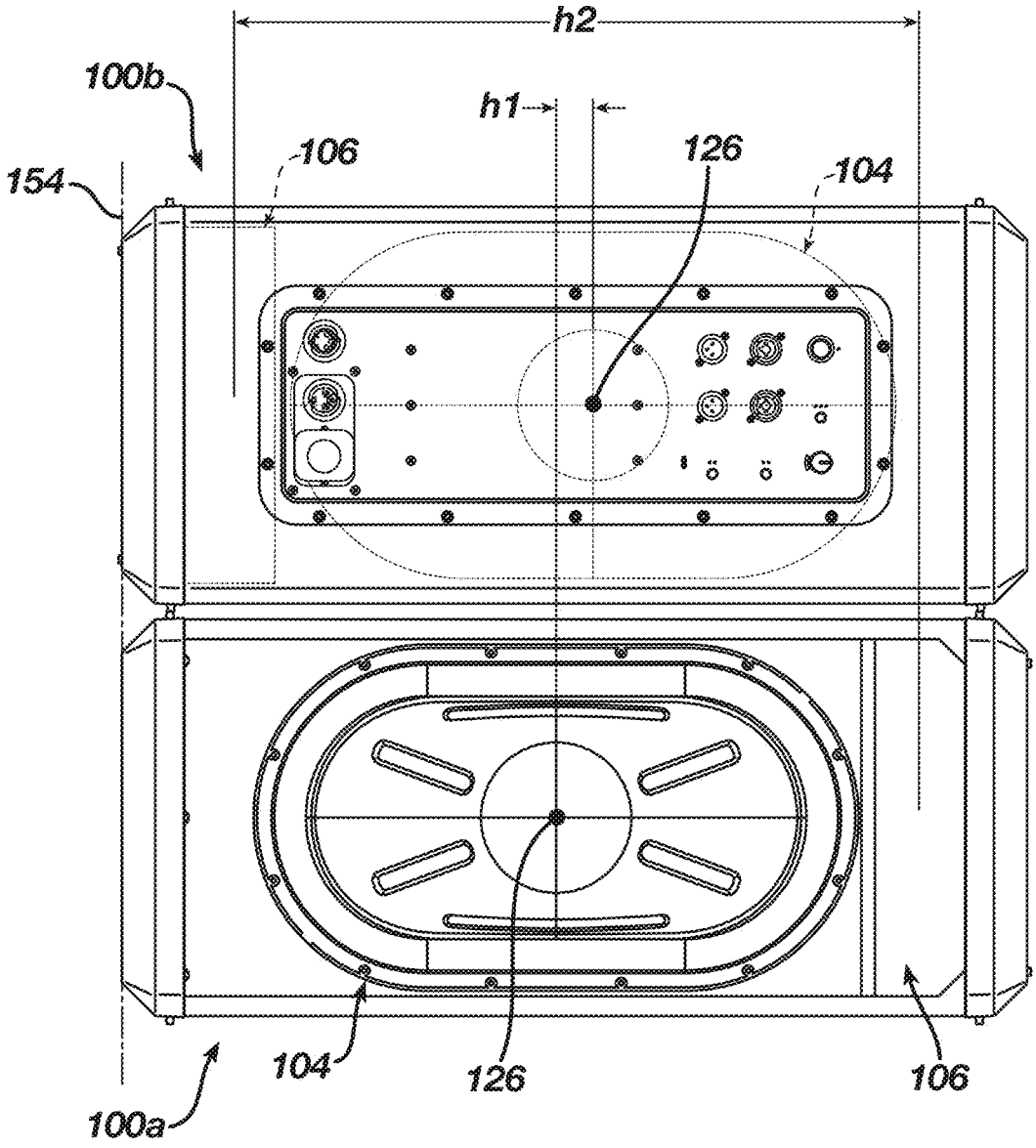
FIG. 7D is a front view of loudspeaker stacked improperly in cardioid configuration.

As shown in FIG. 7C, the keyed features 116 also inhibit improper stacking in the cardioid configuration. In that regard, the keyed features 116 are arranged such that they do not interlock when the top wall 108*a* of the first loudspeaker 100*a* is arranged in a vertical plane 154 with the bottom wall 108*b* of the second loudspeaker 100*b*. In that regard, when the loudspeakers 100*a*, 100*b* are not properly stacked in the cardioid configuration, the protrusions 116*a* in the respective loudspeakers 100*a*, 100*b* interfere with each other. With reference to FIG. 7D, this inhibits a stacking of the loudspeakers 100*a*, 100*b* that would result in the respective motion axes 126 of the electro-acoustic transducers 104 being horizontally offset from each other by a distance, h1, as well as the respective ports 16 being horizontally offset from each other by a distance, h2.

As mentioned above, when stacked in the cardioid configuration, one of the loudspeakers 100*a*, 100*b* in the stack will be placed in cardioid mode. The loudspeaker placed in cardioid mode will introduce a phase shift and a time delay to the audio signal that is fed to its electro-acoustic transducer 104. This phase shift and time delay ensure that the output of the two loudspeakers destructively interfere in the rear of the stack and constructively interfere in the front of the stack to produce the cardioid pattern. This results in directional low frequencies, which are otherwise omnidirectional. The rear of the stack being the side that the front wall of the loudspeaker speaker operating in cardioid mode faces, the front of the stack being the side which the front wall of the other loudspeaker faces; i.e., the side that the rear wall of the loudspeaker operating in cardioid mode faces. Engagement of cardioid mode may be by operation of a switch or button 156 (FIG. 1B) on the i/o panel 110 on the rear wall 108*f* of the loudspeaker 100 that is to operate in cardioid mode.

OTHER IMPLEMENTATIONS

A number of implementations have been described. Nevertheless, it will be understood that additional modifications may be made without departing from the scope of the inventive concepts described herein.

Figure 8A:
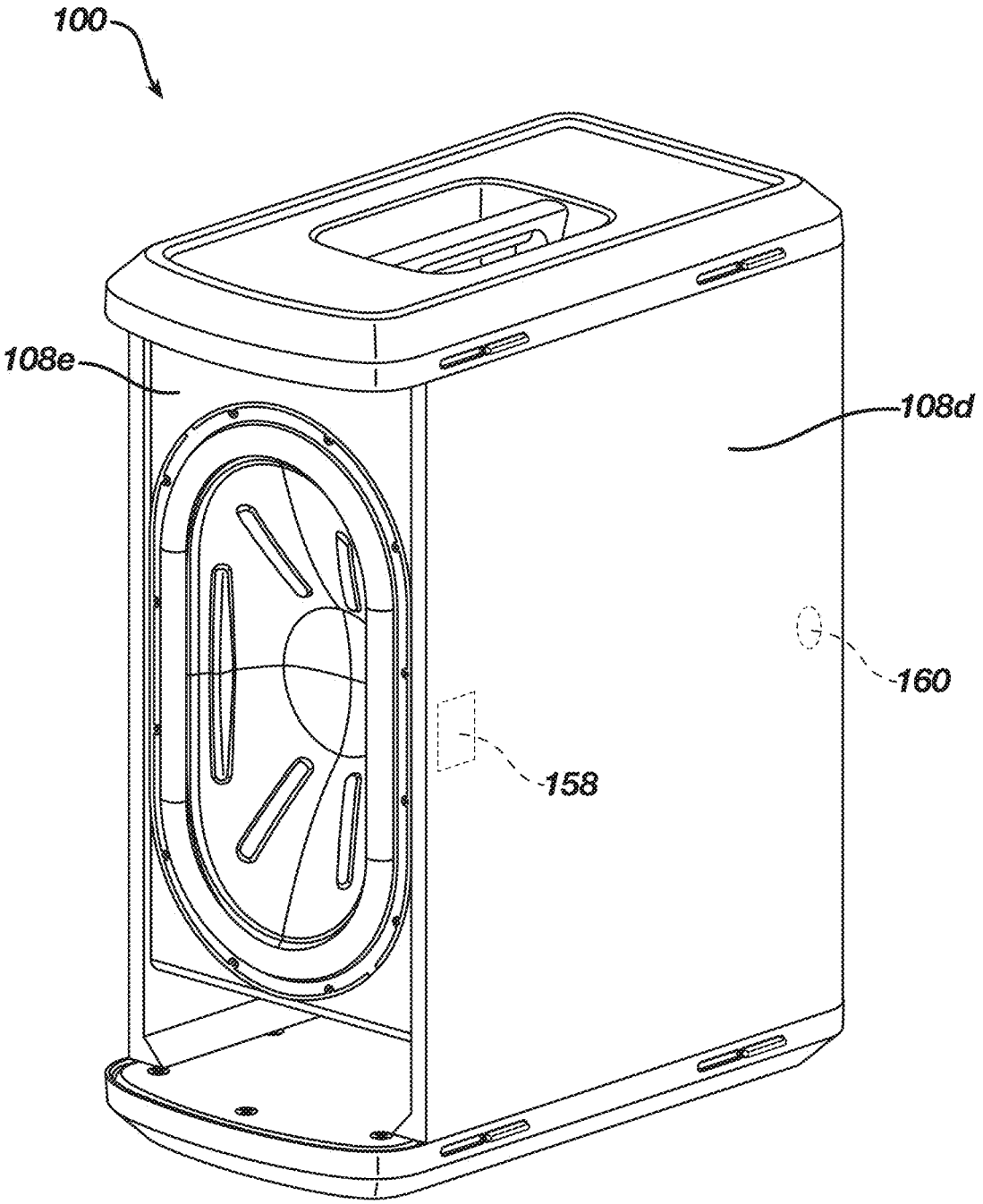
FIG. 8A is a front perspective view of a loudspeaker with Hall effect sensor & magnet.
Figure 8B:
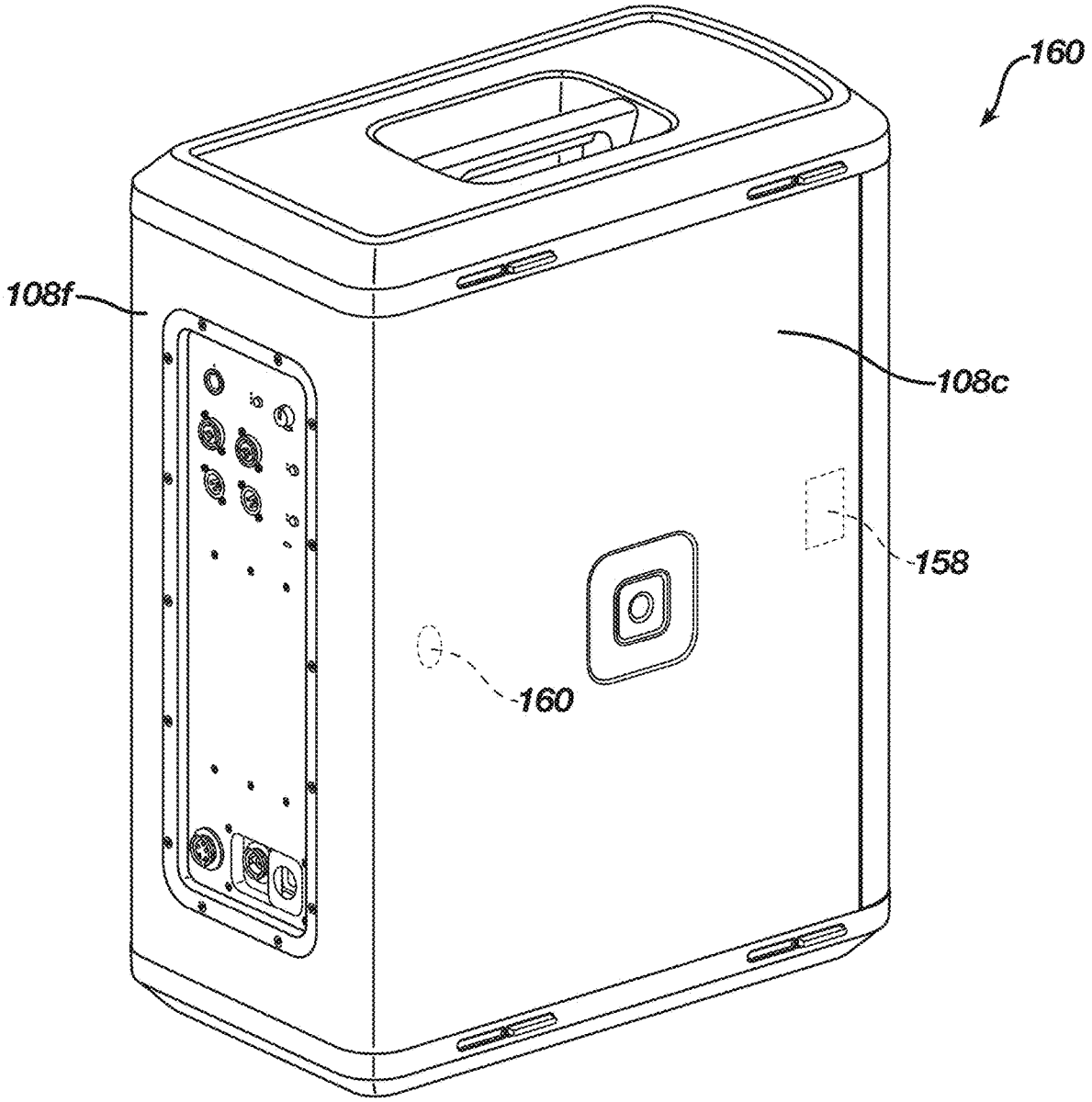
FIG. 8B is rear perspective view of the loudspeaker of FIG. 8A.

As an example, in some implementations, the loudspeakers, when stacked in a cardioid configuration, may automatically detect that they are in the cardioid configuration and automatically place one of the loudspeakers in cardioid mode. For example, the loudspeakers may be provided with sensors that are capable of sensing when the loudspeakers are stacked in a cardioid configuration. For example, with reference to FIGS. 8A, 8B, the loudspeakers 100 (one shown) may be provided with a combination of Hall effect sensors 158 and magnets 160. In the illustrated example, the Hall effect sensors 158 are disposed on the left and right sidewalls 108*c*, 108*d* near the front wall 108*e*, and the magnets 160 are disposed on the left and right sidewalls 108*c*, 108*d* near the rear wall 108*f*. When stacked in the cardioid configuration, the magnet 160 on one of the loudspeakers 100 will align with the Hall effect sensor 158 on the other loudspeaker 100. The electronics 130 (FIG. 3) may include a processor for reading signals from the sensor and initiating cardioid mode. In some cases, stacked loudspeakers may communicate with each other, e.g., via a cable connection through the i/o panel 114 (FIG. 1B), or wirelessly via communication hardware provided with the electronics. The loudspeakers 100 may decide via communications between them which device will be operated in cardioid mode. In some cases, the loudspeakers 100 can be coupled together in a daisy-chain configuration (e.g., via a cabling connection) for distribution of an audio signal and/or data. When the loudspeakers are coupled together in a daisy-chain configuration, the upstream (or, alternatively, the downstream) loudspeaker may automatically be designated to operate in cardioid mode when the loudspeakers detect that they are stacked in a cardioid configuration.

Additional details regarding the automatic detection and automatic initiation of cardioid mode can be found in U.S. patent application Ser. No. 16/438,138, titled "Auto-Configurable Bass Loudspeaker," filed Jun. 11, 2019, the complete disclosure of which is incorporated herein by reference.

Figure 9A:
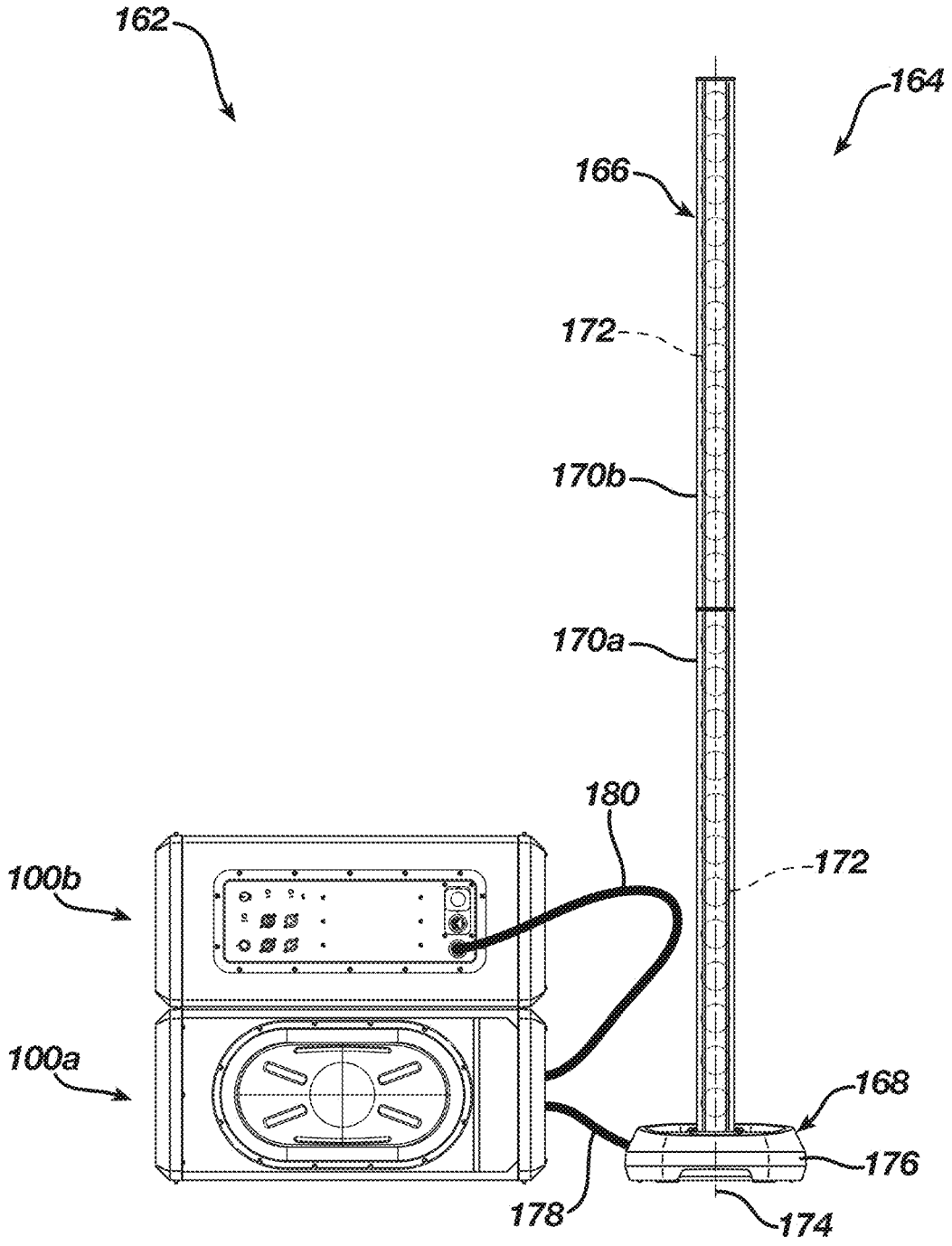
FIG. 9A is a front view of an audio system including a pair of loudspeakers coupled with a line array loudspeaker.
Figure 9B:
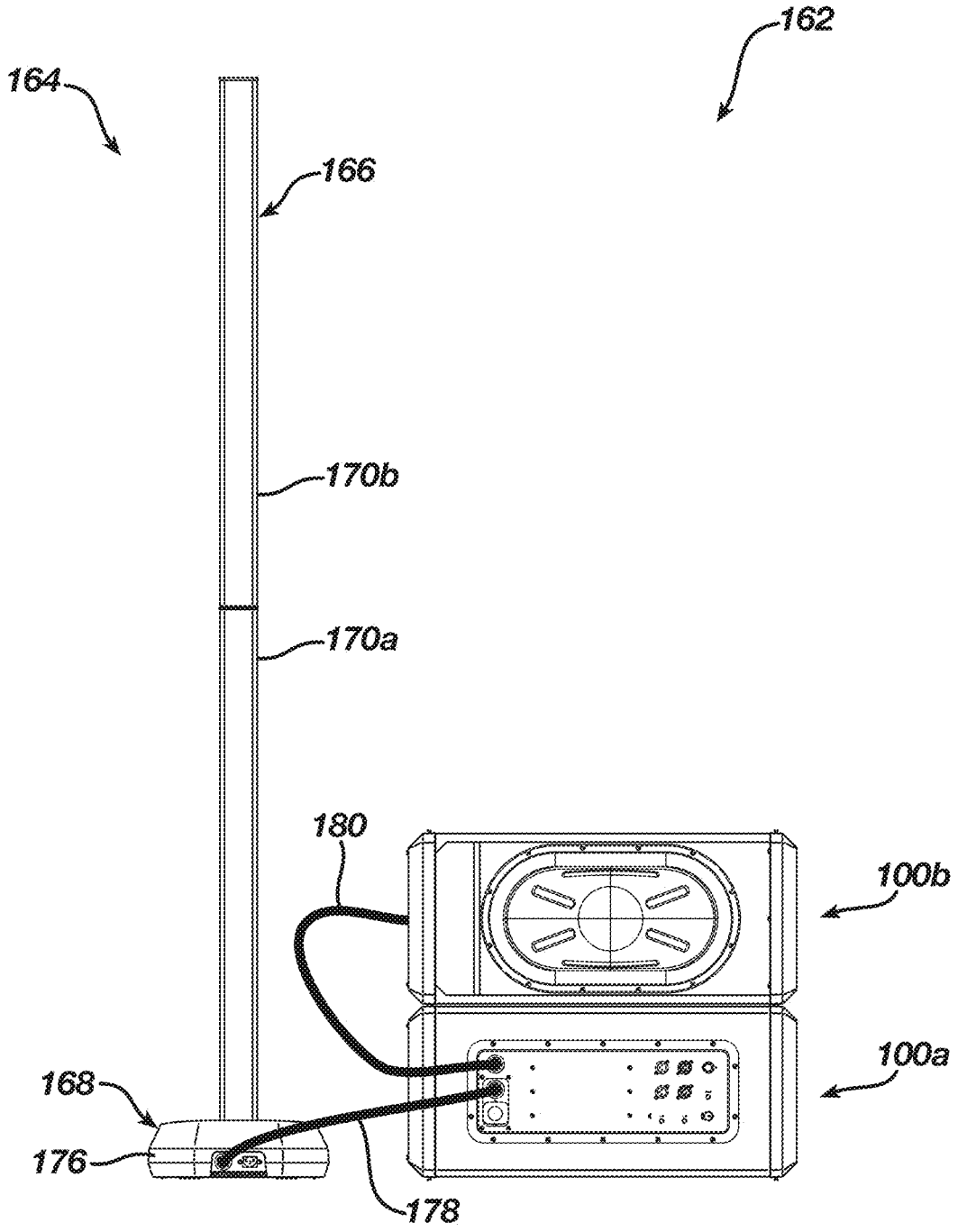
FIG. 9B is a rear view of the audio system of FIG. 9A.

In some cases, the loudspeakers may be coupled with a line array loudspeaker to provide an audio system 162, as shown in FIGS. 9A & 9B. The line array loudspeaker 164 (a/k/a "array loudspeaker system" or "loudspeaker system") includes an array assembly 166 and a base 168. In the illustrated example, the array assembly 166 includes a pair of array housings 170*a*, 170*b* that each support an associated plurality of electro-acoustic transducers 172 arranged along a vertical axis 174 and configured to radiate acoustic energy outwardly from a front surface of the associated one of the array housings 170*a*, 170*b*. The base 168 includes a base housing 176 which receives and supports the array assembly 166. The base housing 176 houses electronics which power the electro-acoustic transducers 172. Additional details regarding the line array loudspeaker may be found in U.S. patent application Ser. No. 16/669,682, titled "Loudspeaker System Cooling," filed Oct. 31, 2019, the complete disclosure of which is incorporated herein by reference.

In the illustrated example, a first one of the loudspeakers ("first loudspeaker 100*a*") is coupled to the line array loudspeaker 164 via a first cable connection 178 in which audio is provided to the first loudspeaker 100*a* from the line array loudspeaker 164. A second one of the loudspeakers ("second loudspeaker 100*b*"), in turn, is coupled to the first loudspeaker 100*a* via a second cable connection 180 in a daisy-chain configuration in which the first loudspeaker 100*a* relays the audio signal received from the line array loudspeaker 164 to the second loudspeaker 100*b*. In some cases, data, audio, and power may be provided over the first and second cable connections 178, 180. Suitable cable connections for this purpose are described in U.S. patent application Ser. No. 16/456,348, titled "Active Loudspeaker and Cable Assembly," filed Jun. 28, 2019, the complete disclosure of which is incorporated herein by reference.

As mentioned above, in some cases, the loudspeakers 100*a*, 100*b* (generally "100") may be capable of automatically detecting that they are in a cardioid configuration and may be configured to automatically place the downstream (or upstream) loudspeaker 100 in cardioid mode with a phase shift and time delay being applied to the audio signal provided the electro-acoustic transducer of the loudspeaker 100 that is placed in cardioid mode.

Alternatively, or additionally, the loudspeakers 100 and the line array loudspeaker 164 may each include an electronic compass (magnetometer). Magnetometer readings could be used to determine the direction of audio output from the line array loudspeaker (relative to Earth's magnetic north pole). When the loudspeakers 100 detect, via sensors, that they are in the cardio configuration, the loudspeaker 100 having the magnetometer reading that most closely matches that of the line array loudspeaker 164 can be assumed to be the forward-facing loudspeaker and the other one of the two loudspeakers can be placed in cardio mode.

Figure 10A:
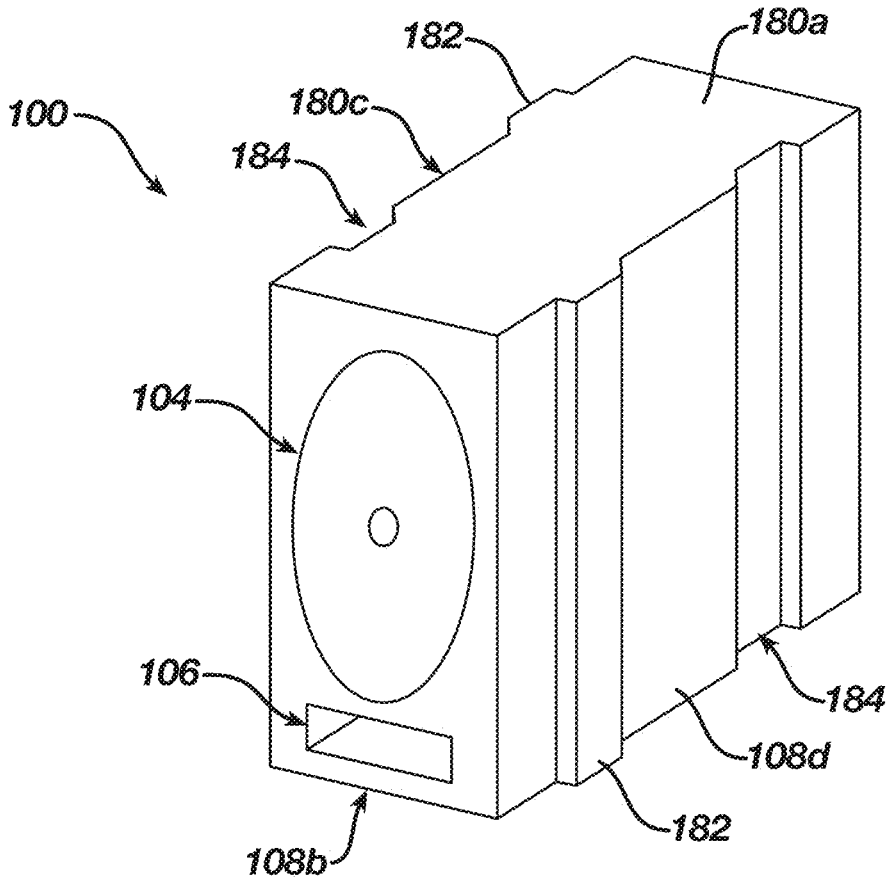
FIG. 10A is a front perspective view of a loudspeaker with tongue-and-groove keyed features.
Figure 10B:
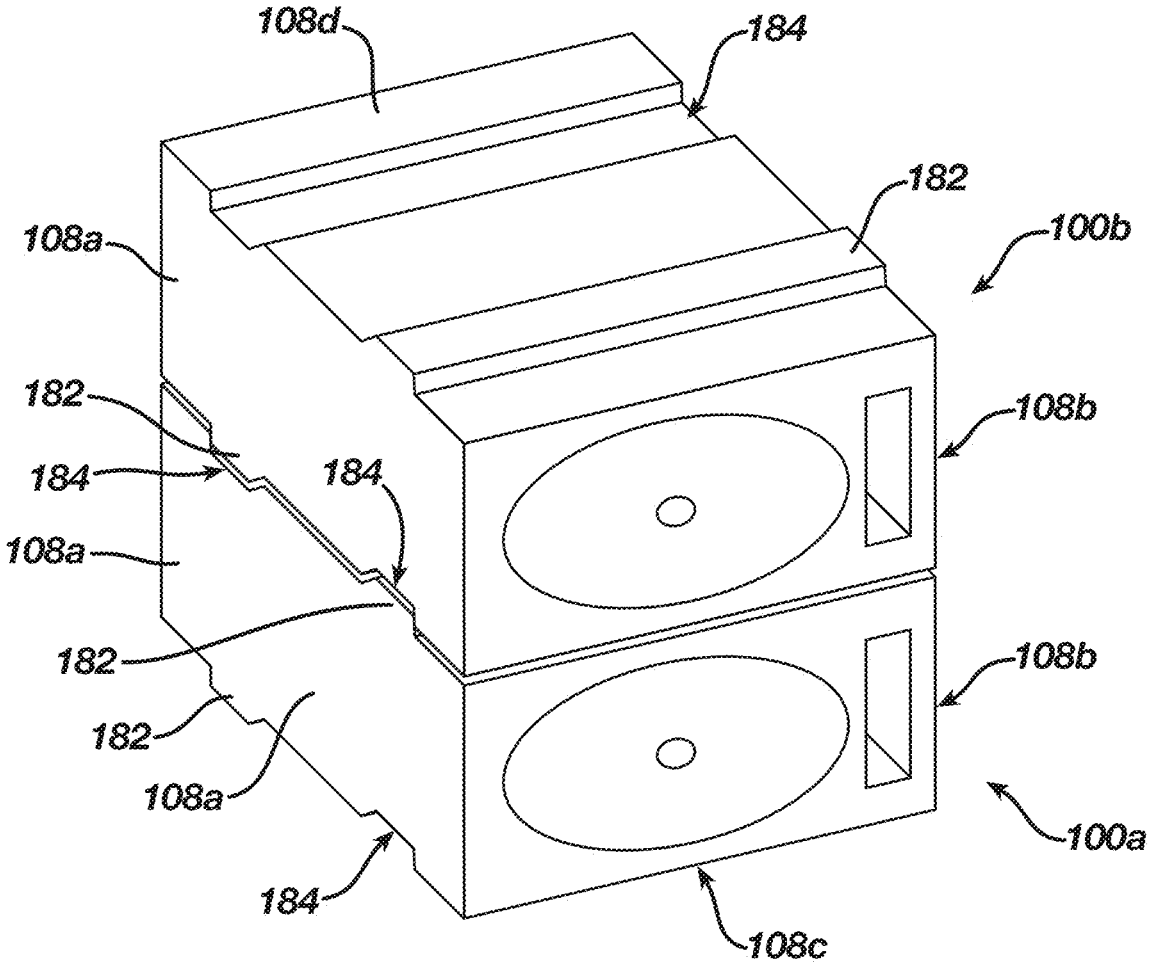
FIG. 10B is a front perspective view of stacked loudspeakers with tongue-and-groove keyed features.

While an implementation has been described above in which the keyed features comprise interlocking feet and pockets, other configurations of keyed features are also contemplated. For example, FIG. 10A illustrates another implementation in which the keyed features comprise protrusions in the form of an outwardly extending tongue 182, and recesses in the form of grooves 184. As shown in FIG. 10B, the tongues 182 and grooves 184 each extend the height of the sidewalls 108*c*, 108*c*, from the bottom wall 108*b* to the top wall 108*a*. In the illustrated example, each of the left and right sidewalls 108*c*, 108*d* includes one tongue 182 and one groove 184. As shown in FIG. 10B, when stacked, the tongue 182 of one loudspeaker 100*a* engages the groove 184 of the other loudspeaker 100*b*, and vice versa.

Figure 1A:
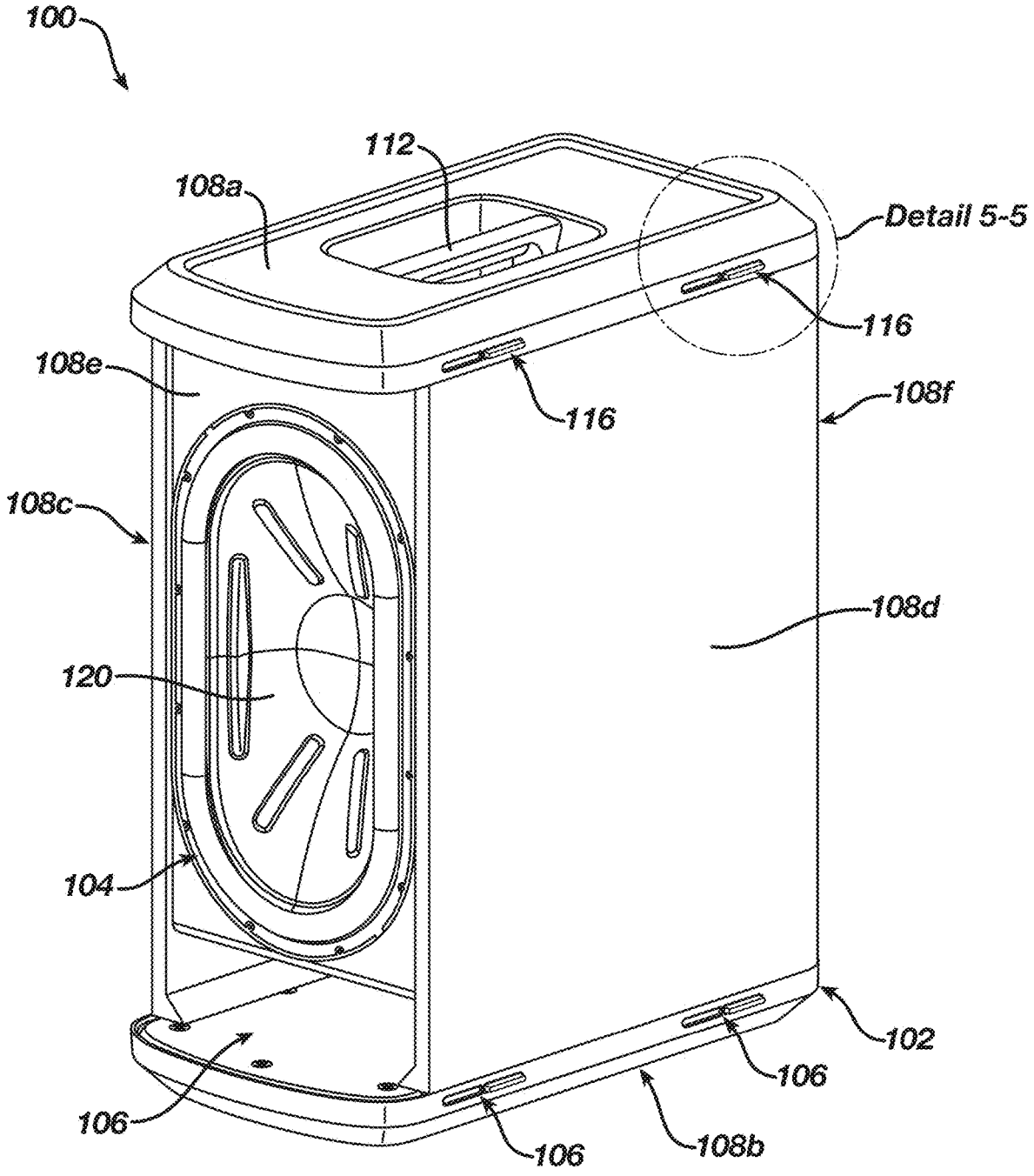
FIG. 1A perspective view of a loudspeaker as viewed from the front, top, and right side.
Figure 1B:
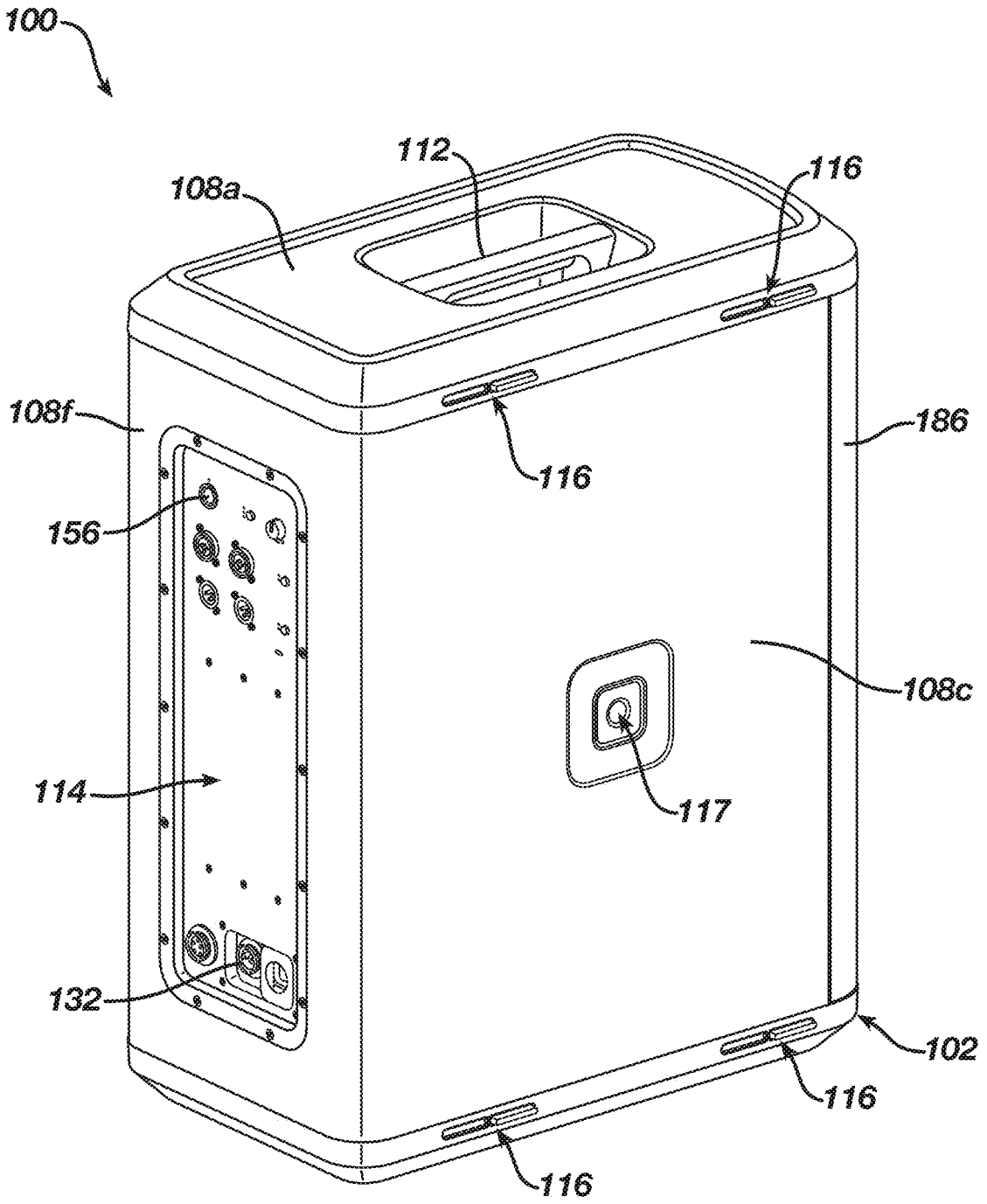
FIG. 1B perspective view of the loudspeaker of FIG. 1A as viewed from the rear, top, and left side.
Figure 2:
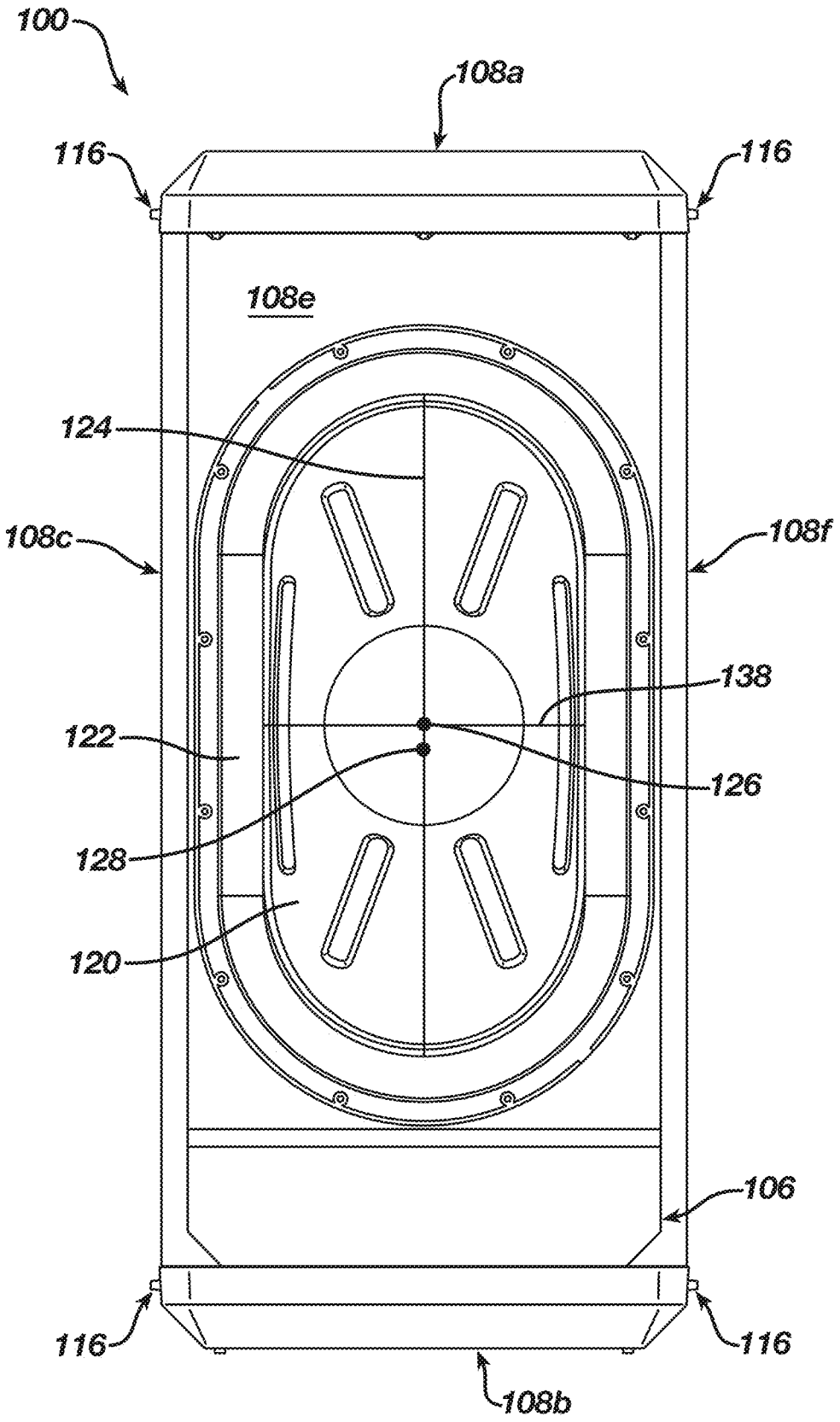
FIG. 2 is a front view of the loudspeaker of FIG. 1A.
Figure 11:
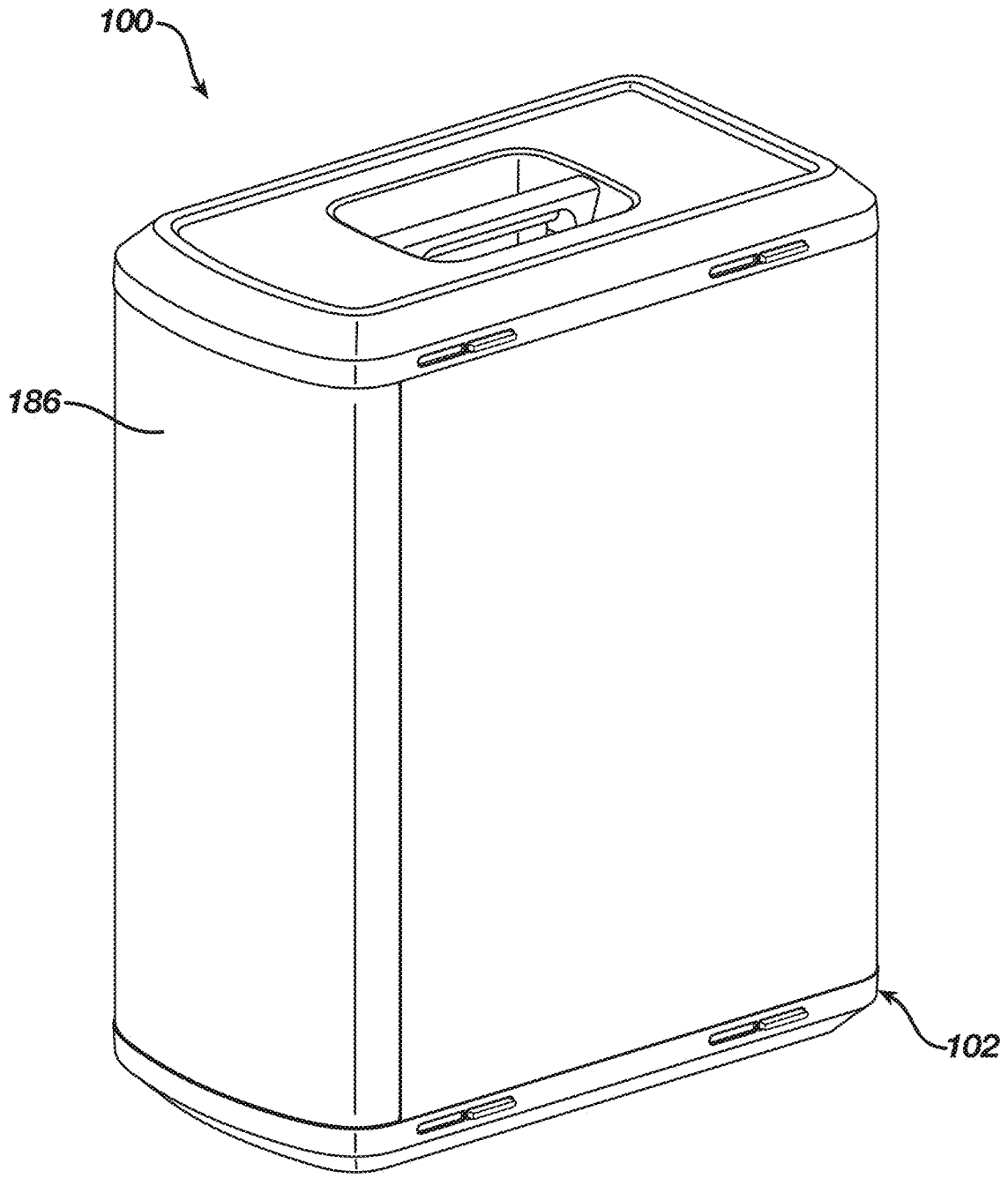
FIG. 11 is a perspective view of the loudspeaker of FIG. 1A, shown with a grille, as viewed from the front, top, and right side.

In some implementations, the loudspeaker 100 may include an acoustically transparent grille 186 that covers the electro-acoustic transducer 104 and the bass reflex port 106 along the front wall of the housing 102, as shown in FIG. 11 (see also "grille 186" in FIG. 1B).

While several implementations have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the implementations described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific implementations described herein. It is, therefore, to be understood that the foregoing implementations are presented by way of example only and that, within the scope of the appended claims and equivalents thereto, implementations may be practiced otherwise than as specifically described and claimed. Implementations of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

A number of implementations have been described. Nevertheless, it will be understood that additional modifications may be made without departing from the scope of the inventive concepts described herein, and, accordingly, other implementations are within the scope of the following claims.

What is claimed is:

1. A loudspeaker comprising a housing comprising a plurality of walls which together define an acoustic cavity;

an electro-acoustic transducer mounted to a front wall of the housing;

wherein a motion axis of the electro-acoustic transducer is offset from a centroid of the front wall;

wherein the loudspeaker is configured to be stacked with an other loudspeaker of identical construction in a physical first configuration with respect to each other such that the stacked loudspeakers radiate acoustic energy to produce an omnidirectional radiation pattern; and in a physical second configuration with respect to each other such that the stacked loudspeakers radiate acoustic energy to produce a cardioid radiation pattern, wherein according to one of the physical first or second configuration the front wall of each of the loudspeakers face in the same direction and in the other of the physical first or second configuration the front wall of each of the loudspeakers face in opposing directions, and wherein the loudspeaker comprises keyed features which do not interlock and thereby inhibit stacking when the loudspeaker is in a first orientation relative to the other loudspeaker, and which interlock to allow stacking when the loudspeaker is in a second orientation relative to the other loudspeaker.

2. The loudspeaker of claim 1, further comprising electronics for processing an electrical audio signal and powering the transducer, wherein the electronics are configured to introduce phase shift and time delay to the electrical audio signal when the loudspeaker is stacked with the other loudspeaker in the second configuration.

3. The loudspeaker of claim 1, wherein the keyed features of the loudspeaker and the other loudspeaker are arranged to as to interlock when the respective motion axes of the electro-acoustic transducers of the loudspeakers are aligned in a vertical plane in each of the first and second configurations.

4. The loudspeaker of claim 1, wherein the plurality of walls comprises the front wall, a top wall, a bottom wall, and a plurality of sidewalls that extend between the top wall and the bottom wall, wherein the keyed features of the loudspeaker and the other loudspeaker are arranged so as to interlock when the respective top walls of the housings of the loudspeakers are aligned in a vertical plane in each of the first and second configurations.

5. The loudspeaker of claim 1, wherein the keyed features of the loudspeaker and the other loudspeaker are arranged such that they do not interlock when the top wall of the loudspeaker is arranged in a vertical plane with the bottom wall of the other loudspeaker.

6. The loudspeaker of claim 1, further comprising a port extending through the front wall, wherein the keyed features of the loudspeaker and the other loudspeaker are arranged to as to interlock when the respective ports of the loudspeakers are aligned in a vertical plane in each of the first and second configurations.

7. The loudspeaker of claim 1, wherein the electro-acoustic transducer comprises a diaphragm having a major axis and a minor axis, and wherein the major axis is longer than the minor axis.

8. The loudspeaker of claim 7, wherein the diaphragm is in the shape of an ellipse, an oval, or a racetrack.

9. The loudspeaker of claim 1, wherein the plurality of walls comprises the front wall, a top wall, a bottom wall, and a plurality of sidewalls that extend between the top wall and the bottom wall, wherein the sidewalls are substantially parallel with the major axis of the electro-acoustic transducer, and wherein the top wall has a handle such that the loudspeaker can be carried with the major axis arranged vertical to ground.

10. The loudspeaker of claim 1, wherein the loudspeaker comprises a sensor that is configured to detect when the loudspeaker is arranged in the second configuration with the other loudspeaker, and, in response, automatically applies a phase shift and a time delay to an electrical audio signal that is used to drive the electro-acoustic transducer.

11. The loudspeaker of claim 1, wherein the keyed features comprise protrusions and recesses which interlock when properly aligned.

12. An audio system comprising first and second loudspeakers, each comprising:

a housing comprising a plurality of walls which together define an acoustic cavity;

an electro-acoustic transducer mounted to a front wall of the housing; and keyed features, wherein a motion axis of the electro-acoustic transducer is offset from a centroid of the front wall;

wherein the first and second loudspeakers are configured to be stacked on top of one another in a physical first configuration with respect to each other such that the first and second loudspeakers radiate acoustic energy to produce an omnidirectional radiation pattern; and in a physical second configuration with respect to each other such that the first and second loudspeakers radiate acoustic energy to produce a cardioid radiation pattern, wherein according to one of the physical first or second configuration the front wall of each of the loudspeakers face in the same direction and in the other of the physical first or second configuration the front wall of each of the loudspeakers face in opposing directions, and wherein the respective keyed features of the first and second loudspeakers do not interlock and thereby inhibit stacking when the first and second loudspeakers are in a first orientation relative to each other, and interlock to allow stacking when the first and second loudspeakers are in a second orientation relative to each other.

13. The audio system of claim 12, wherein the first and second loudspeakers are configured to automatically detect when they are stacked in the second configuration.

14. The system of claim 12, wherein the first and second loudspeakers are configured to be coupled with a line array loudspeaker and wherein the loudspeaker comprises: an array housing; and a plurality of electro-acoustic transducers arranged along a vertical axis and configured to radiate acoustic energy outwardly from a front surface of the array housing.

15. The system of claim 14, wherein the first and second loudspeakers are configured to automatically detect which one of the first and second loudspeakers has its front wall facing in the direction that the line array is radiating acoustic energy, and, automatically apply a phase shift and a time delay to an audio signal that is used to drive the electro-acoustic transducer of the other one of the first and second loudspeakers.

* * * * *